US009763020B2

(12) United States Patent
Lang et al.

(10) Patent No.: US 9,763,020 B2
(45) Date of Patent: Sep. 12, 2017

(54) VIRTUAL STEREO SYNTHESIS METHOD AND APPARATUS

(71) Applicant: Huawei Technologies Co., Ltd., Shenzhen (CN)

(72) Inventors: Yue Lang, Beijing (CN); Zhengzhong Du, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 15/137,493

(22) Filed: Apr. 25, 2016

(65) Prior Publication Data

US 2016/0241986 A1 Aug. 18, 2016

Related U.S. Application Data

(63) Continuation of application No. PCT/CN2014/076089, filed on Apr. 24, 2014.

(30) Foreign Application Priority Data

Oct. 24, 2013 (CN) ..... 2013 1 0508593

(51) Int. Cl.
*H04S 7/00* (2006.01)
*H04S 3/00* (2006.01)
(Continued)

(52) U.S. Cl.
CPC ..... *H04S 7/307* (2013.01); *H04R 5/033* (2013.01); *H04R 5/04* (2013.01); *H04S 1/002* (2013.01);
(Continued)

(58) Field of Classification Search
CPC ..... H04S 2420/01; H04S 7/307; H04S 1/002; H04S 1/005; H04S 3/004; H04S 2400/11;
(Continued)

(56) References Cited

U.S. PATENT DOCUMENTS 6,072,877 A 6/2000 Abel
6,243,476 B1 6/2001 Gardner
(Continued)

FOREIGN PATENT DOCUMENTS

CN 1630434 A 6/2005
CN 101184349 A 5/2008
(Continued)

OTHER PUBLICATIONS

Foreign Communication From a Counterpart Application, Chinese Application No. 201310508593.8, Chinese Office Action dated Apr. 29, 2016, 5 pages.
(Continued)

*Primary Examiner* — David Ton
(74) *Attorney, Agent, or Firm* — Conley Rose, P.C.

(57) ABSTRACT

A virtual stereo synthesis method includes acquiring at least one sound input signal on a first side and at least one sound input signal on a second side, separately performing ratio processing on a preset head related transfer function (HRTF) left-ear component and a preset HRTF right-ear component of each sound input signal on the second side, to obtain a filtering function of each sound input signal on the second side, separately performing convolution filtering on each sound input signal on the second side and the filtering function of the sound input signal on the second side, to obtain the filtered signal on the second side, and synthesizing all of the sound input signals on the first side and all of the filtered signals on the second side into a virtual stereo signal where the method may alleviate a coloration effect, and reduce calculation complexity.

20 Claims, 4 Drawing Sheets

(51) Int. Cl.
*H04R 5/033* (2006.01)
*H04R 5/04* (2006.01)
*H04S 1/00* (2006.01)

(52) U.S. Cl.
CPC ..... *H04S 1/005* (2013.01); *H04S 3/004* (2013.01); *H04S 7/306* (2013.01); *H04S 2400/11* (2013.01); *H04S 2400/15* (2013.01); *H04S 2420/01* (2013.01)

(58) Field of Classification Search
CPC ..... H04S 2400/15; H04S 7/306; H04R 5/033; H04R 5/04
USPC ..... 381/310, 309, 74
See application file for complete search history.

(56) References Cited

U.S. PATENT DOCUMENTS

| | | | | |
|---|---|---|---|---|
| 6,768,798 | B1 | 7/2004 | Dempsey | |
| 2005/0135643 | A1 | 6/2005 | Lee et al. | |
| 2006/0062409 | A1 | 3/2006 | Sferrazza | |
| 2006/0062410 | A1 | 3/2006 | Kim et al. | |
| 2008/0031462 | A1* | 2/2008 | Walsh | H04S 3/02 381/17 |
| 2008/0159544 | A1 | 7/2008 | Kim | |
| 2011/0243338 | A1* | 10/2011 | Brown | H04S 3/002 381/17 |

FOREIGN PATENT DOCUMENTS

| | | | |
|---|---|---|---|
| CN | 101212843 | A | 7/2008 |
| CN | 101483797 | A | 7/2009 |

OTHER PUBLICATIONS

Foreign Communication From a Counterpart Application, PCT Application No. PCT/CN2014/076089, English Translation of International Search Report dated Jul. 29, 2014, 2 pages.
Foreign Communication From a Counterpart Application, PCT Application No. PCT/CN2014/076089, English Translation of Written Opinion dated Jul. 29, 2014, 5 pages.
Foreign Communication From a Counterpart Application, European Application No. 14856259.8, Extended European Search Report dated Oct. 4, 2016, 7 pages.

* cited by examiner

VIRTUAL STEREO SYNTHESIS METHOD AND APPARATUS

CROSS-REFERENCE TO RELATED APPLICATIONS

This application is a continuation of International Application No. PCT/CN2014/076089, filed on Apr. 24, 2014, which claims priority to Chinese Patent Application No. 201310508593.8, filed on Oct. 24, 2013, both of which are hereby incorporated by reference in their entireties.

TECHNICAL FIELD

This application relates to the field of audio processing technologies, and in particular, to a virtual stereo synthesis method and apparatus.

BACKGROUND

Currently, headsets are widely applied to enjoy music and videos. When a stereo signal is replayed by a headset, an effect of head orientation often appears, causing an unnatural listening effect. Researches show that, the effect of head orientation appears because: 1) The headset directly transmits, to both ears, a virtual sound signal that is synthesized from left and right channel signals, where unlike a natural sound, the virtual sound signal is not scattered or reflected by the head, auricles, body, and the like of a person, and the left and right channel signals in the synthetic virtual sound signal are not superimposed in a cross manner, which damages space information of an original sound field, 2) The synthetic virtual sound signal lacks early reflection and late reverberation in a room, thereby affecting a listener in feeling a sound distance and a space size.

To reduce the effect of head orientation, in the prior art, data that can express a comprehensive filtering effect from a physiological structure or an environment on a sound wave is obtained by means of measurement in an artificially simulated listening environment. A common manner is that, a head related transfer function (HRTF) is measured in an anechoic chamber using an artificial head, to express the comprehensive filtering effect from the physiological structure on the sound wave. As shown in FIG. 1, cross convolution filtering is performed on input left and right channel signals $s_l(n)$ and $s_r(n)$, to obtain virtual sound signals $s^l(n)$ and $s^r(n)$ that are separately output to left and right ears, where:

$$s^l(n)=\mathrm{conv}(h_{\theta_l}{}^l(n),s_l(n))+\mathrm{conv}(h_{\theta_r}{}^l(n),s_r(n))$$

$$s^r(n)=\mathrm{conv}(h_{\theta_l}{}^r(n),s_l(n))+\mathrm{conv}(h_{\theta_r}{}^r(n),s_r(n)),$$

where conv(x,y) represents a convolution of vectors x and y, $h_{\theta_l}{}^l(n)$ and $h_{\theta_l}{}^r(n)$ are respectively HRTF data from a simulated left speaker to left and right ears, and $h_{\theta_r}{}^l(n)$ and $h_{\theta_r}{}^r(n)$ are respectively HRTF data from a simulated right speaker to left and right ears. However, in the foregoing manner, to obtain the virtual sound signal, convolution needs to be separately performed on the left and right channel signals, which causes impact on original frequencies of the left and right channel signals, thereby generating a coloration effect, and also increasing calculation complexity.

In the prior art, stereo simulation is further performed, using binaural room impulse response (BRIR) data in replacement of the HRTF data, on signals that are input from left and right channels, where the BRIR data further includes the comprehensive filtering effect from the environment on the sound wave. Although the BRIR data has an improved stereo effect compared with the HRTF data, calculation complexity of the BRIR data is higher, and the coloration effect still exists.

SUMMARY

Present application provides a virtual stereo synthesis method and apparatus, which can improve a coloration effect, and reduce calculation complexity.

To resolve the foregoing technical problem, a first aspect of this application provides a virtual stereo synthesis method, where the method includes acquiring at least one sound input signal on one side and at least one sound input signal on the other side, separately performing ratio processing on a preset HRTF left-ear component and a preset HRTF right-ear component of each sound input signal on the other side, to obtain a filtering function of each sound input signal on the other side, separately performing convolution filtering on each sound input signal on the other side and the filtering function of the sound input signal on the other side, to obtain the filtered signal on the other side, and synthesizing all of the sound input signals on the one side and all of the filtered signals on the other side into a virtual stereo signal.

With reference to the first aspect, a first possible implementation manner of the first aspect of this application is the step of separately performing ratio processing on a preset HRTF left-ear component and a preset HRTF right-ear component of each sound input signal on the other side, to obtain a filtering function of each sound input signal on the other side includes separately using a ratio of a left-ear frequency domain parameter to a right-ear frequency domain parameter of each sound input signal on the other side as a frequency-domain filtering function of each sound input signal on the other side, where the left-ear frequency domain parameter indicates the preset HRTF left-ear component of the sound input signal on the other side, and the right-ear frequency domain parameter indicates the preset HRTF right-ear component of the sound input signal on the other side, and separately transforming the frequency-domain filtering function of each sound input signal on the other side to a time-domain function, and using the time-domain function as the filtering function of each sound input signal on the other side.

With reference to the first possible implementation manner of the first aspect, a second possible implementation manner of the first aspect of this application is the step of separately transforming the frequency-domain filtering function of each sound input signal on the other side to a time-domain function, and using the time-domain function as the filtering function of each sound input signal on the other side includes separately performing minimum phase filtering on the frequency-domain filtering function of each sound input signal on the other side, then transforming the frequency-domain filtering function to the time-domain function, and using the time-domain function as the filtering function of each sound input signal on the other side.

With reference to the first or the second possible implementation manner of the first aspect, a third possible implementation manner of the first aspect of this application is, before the step of separately using a ratio of a left-ear frequency domain parameter to a right-ear frequency domain parameter of each sound input signal on the other side as a frequency-domain filtering function of each sound input signal on the other side, the method further includes separately using a frequency domain of the preset HRTF left-ear component of each sound input signal on the other side as the left-ear frequency domain parameter of each sound input signal on the other side, and separately using a frequency domain of the preset HRTF right-ear component of each sound input signal on the other side as the right-ear frequency domain parameter of each sound input signal on the other side, or separately using a frequency domain, after diffuse-field equalization or subband smoothing, of the preset HRTF left-ear component of each sound input signal on the other side as the left-ear frequency domain parameter of each sound input signal on the other side, and separately using a frequency domain, after diffuse-field equalization or subband smoothing, of the preset HRTF right-ear component of each sound input signal on the other side as the right-ear frequency domain parameter of each sound input signal on the other side, or separately using a frequency domain, after diffuse-field equalization and subband smoothing is performed in sequence, of the preset HRTF left-ear component of each sound input signal on the other side as the left-ear frequency domain parameter of each sound input signal on the other side, and separately using a frequency domain, after diffuse-field equalization and subband smoothing is performed in sequence, of the preset HRTF right-ear component of each sound input signal on the other side as the right-ear frequency domain parameter of each sound input signal on the other side.

With reference to the first aspect or any one of the first to the third possible implementation manners, a fourth possible implementation manner of the first aspect of this application is the step of separately performing convolution filtering on each sound input signal on the other side and the filtering function of the sound input signal on the other side, to obtain a filtered signal on the other side includes separately performing reverberation processing on each sound input signal on the other side, and then using the processed signal as a sound reverberation signal on the other side, and separately performing convolution filtering on each sound reverberation signal on the other side and the filtering function of the corresponding sound input signal on the other side, to obtain the filtered signal on the other side.

With reference to the fourth possible implementation manner of the first aspect, a fifth possible implementation manner of the first aspect of this application is the step of separately performing reverberation processing on each sound input signal on the other side, and then using the processed signal as a sound reverberation signal on the other side includes separately passing each sound input signal on the other side through an all-pass filter, to obtain a reverberation signal of each sound input signal on the other side, and separately synthesizing each sound input signal on the other side and the reverberation signal of the sound input signal on the other side into the sound reverberation signal on the other side.

With reference to the first aspect or any one of the first to the fifth possible implementation manners, a sixth possible implementation manner of the first aspect of this application is the step of synthesizing all of the sound input signals on the one side and all of the filtered signals on the other side into a virtual stereo signal includes summating all of the sound input signals on the one side and all of the filtered signals on the other side to obtain a synthetic signal, and performing, using a fourth-order infinite impulse response (IIR) filter, timbre equalization on the synthetic signal, and then using the timbre-equalized synthetic signal as the virtual stereo signal.

To resolve the foregoing technical problem, a second aspect of this application provides a virtual stereo synthesis apparatus, where the apparatus includes an acquiring module, a generation module, a convolution filtering module, and a synthesis module, where the acquiring module is configured to acquire at least one sound input signal on one side and at least one sound input signal on the other side, and send the at least one sound input signal on the one side and at least one sound input signal on the other side to the generation module and the convolution filtering module. The generation module is configured to separately perform ratio processing on a preset HRTF left-ear component and a preset HRTF right-ear component of each sound input signal on the other side, to obtain a filtering function of each sound input signal on the other side, and send the filtering function of each sound input signal on the other side to the convolution filtering module. The convolution filtering module is configured to separately perform convolution filtering on each sound input signal on the other side and the filtering function of the sound input signal on the other side, to obtain the filtered signal on the other side, and send all of the filtered signals on the other side to the synthesis module, and the synthesis module is configured to synthesize a virtual stereo signal from all of the sound input signals on the one side and all of the filtered signals on the other side.

With reference to the second aspect, a first possible implementation manner of the second aspect of this application is the generation module which includes a ratio unit and a transformation unit, where the ratio unit is configured to separately use a ratio of a left-ear frequency domain parameter to a right-ear frequency domain parameter of each sound input signal on the other side as a frequency-domain filtering function of each sound input signal on the other side, and send the frequency-domain filtering function of each sound input signal on the other side to the transformation unit, where the left-ear frequency domain parameter indicates the preset HRTF left-ear component of the sound input signal on the other side, and the right-ear frequency domain parameter indicates the preset HRTF right-ear component of the sound input signal on the other side, and the transformation unit is configured to separately transform the frequency-domain filtering function of each sound input signal on the other side to a time-domain function, and use the time-domain function as the filtering function of each sound input signal on the other side.

With reference to the first possible implementation manner of the second aspect, a second possible implementation manner of the second aspect of this application is the transformation unit which is further configured to separately perform minimum phase filtering on the frequency-domain filtering function of each sound input signal on the other side, then transform the frequency-domain filtering function to the time-domain function, and use the time-domain function as the filtering function of each sound input signal on the other side.

With reference to the first or the second possible implementation manner of the second aspect, a third possible implementation manner of the second aspect of this application is the generation module which includes a processing unit, where the processing unit is configured to separately use a frequency domain of the preset HRTF left-ear component of each sound input signal on the other side as the left-ear frequency domain parameter of each sound input signal on the other side, and separately use a frequency domain of the preset HRTF right-ear component of each sound input signal on the other side as the right-ear frequency domain parameter of each sound input signal on the other side, or separately use a frequency domain, after diffuse-field equalization or subband smoothing, of the preset HRTF left-ear component of each sound input signal on the other side as the left-ear frequency domain parameter of each sound input signal on the other side, and separately use a frequency domain, after diffuse-field equalization or subband smoothing, of the preset HRTF right-ear component of each sound input signal on the other side as the right-ear frequency domain parameter of each sound input signal on the other side, or separately use a frequency domain, after diffuse-field equalization and subband smoothing is performed in sequence, of the preset HRTF left-ear component of each sound input signal on the other side as the left-ear frequency domain parameter of each sound input signal on the other side, and separately use a frequency domain, after diffuse-field equalization and subband smoothing is performed in sequence, of the preset HRTF right-ear component of each sound input signal on the other side as the right-ear frequency domain parameter of each sound input signal on the other side, and send the left ear and right-ear frequency domain parameters to the ratio unit.

With reference to the second aspect or any one of the first to the third possible implementation manners, a fourth possible implementation manner of the second aspect of this application is a reverberation processing module. The reverberation processing module is configured to separately perform reverberation processing on each sound input signal on the other side, then use the processed signal as a sound reverberation signal on the other side, and output all of the sound reverberation signals on the other side to the convolution filtering module, and the convolution filtering module is further configured to separately perform convolution filtering on each sound reverberation signal on the other side and the filtering function of the corresponding sound input signal on the other side, to obtain the filtered signal on the other side.

With reference to the fourth possible implementation manner of the second aspect, a fifth possible implementation manner of the second aspect of this application is the reverberation processing module which is further configured to separately pass each sound input signal on the other side through an all-pass filter, to obtain a reverberation signal of each sound input signal on the other side, and separately synthesize each sound input signal on the other side and the reverberation signal of the sound input signal on the other side into the sound reverberation signal on the other side.

With reference to the second aspect or any one of the first to the fifth possible implementation manners, a sixth possible implementation manner of the second aspect of this application is the synthesis module which includes a synthesis unit and a timbre equalization unit, where the synthesis unit is configured to summate all of the sound input signals on the one side and all of the filtered signals on the other side to obtain a synthetic signal, and send the synthetic signal to the timbre equalization unit, and the timbre equalization unit is configured to perform, using a fourth-order IIR filter, timbre equalization on the synthetic signal and then use the timbre-equalized synthetic signal as the virtual stereo signal.

To resolve the foregoing technical problem, a third aspect of this application provides a virtual stereo synthesis apparatus, where the apparatus includes a processor, where the processor is configured to acquire at least one sound input signal on one side and at least one sound input signal on the other side, separately perform ratio processing on a preset HRTF left-ear component and a preset HRTF right-ear component of each sound input signal on the other side, to obtain a filtering function of each sound input signal on the other side, separately perform convolution filtering on each sound input signal on the other side and the filtering function of the sound input signal on the other side, to obtain the filtered signal on the other side, and synthesize all of the sound input signals on the one side and all of the filtered signals on the other side into a virtual stereo signal.

With reference to the third aspect, a first possible implementation manner of the third aspect of this application is the processor, and the processor is further configured to separately use a ratio of a left-ear frequency domain parameter to a right-ear frequency domain parameter of each sound input signal on the other side as a frequency-domain filtering function of each sound input signal on the other side, where the left-ear frequency domain parameter indicates the preset HRTF left-ear component of the sound input signal on the other side, and the right-ear frequency domain parameter indicates the preset HRTF right-ear component of the sound input signal on the other side, and separately transform the frequency-domain filtering function of each sound input signal on the other side to a time-domain function, and use the time-domain function as the filtering function of each sound input signal on the other side.

With reference to the first possible implementation manner of the third aspect, a second possible implementation manner of the third aspect of this application is the processor, and the processor is further configured to separately perform minimum phase filtering on the frequency-domain filtering function of each sound input signal on the other side, then transform the frequency-domain filtering function to the time-domain function, and use the time-domain function as the filtering function of each sound input signal on the other side.

With reference to the first or the second possible implementation manner of the third aspect, a third possible implementation manner of the third aspect of this application is the processor, and the processor is further configured to separately use a frequency domain of the preset HRTF left-ear component of each sound input signal on the other side as the left-ear frequency domain parameter of each sound input signal on the other side, and separately use a frequency domain of the preset HRTF right-ear component of each sound input signal on the other side as the right-ear frequency domain parameter of each sound input signal on the other side, or separately use a frequency domain, after diffuse-field equalization or subband smoothing, of the preset HRTF left-ear component of each sound input signal on the other side as the left-ear frequency domain parameter of each sound input signal on the other side, and separately use a frequency domain, after diffuse-field equalization or subband smoothing, of the preset HRTF right-ear component of each sound input signal on the other side as the right-ear frequency domain parameter of each sound input signal on the other side, or separately use a frequency domain, after diffuse-field equalization and subband smoothing is performed in sequence, of the preset HRTF left-ear component of each sound input signal on the other side as the left-ear frequency domain parameter of each sound input signal on the other side, and separately use a frequency domain, after diffuse-field equalization and subband smoothing is performed in sequence, of the preset HRTF right-ear component of each sound input signal on the other side as the right-ear frequency domain parameter of each sound input signal on the other side.

With reference to the third aspect or any one of the first to the third possible implementation manners, a fourth possible implementation manner of the third aspect of this application is the processor, and the processor is further configured to separately perform reverberation processing on each sound input signal on the other side and then use the processed signal as a sound reverberation signal on the other side, and separately perform convolution filtering on each sound reverberation signal on the other side and the filtering function of the corresponding sound input signal on the other side, to obtain the filtered signal on the other side.

With reference to the fourth possible implementation manner of the third aspect, a fifth possible implementation manner of the third aspect of this application is the processor, and the processor is further configured to separately pass each sound input signal on the other side through an all-pass filter, to obtain a reverberation signal of each sound input signal on the other side, and separately synthesize each sound input signal on the other side and the reverberation signal of the sound input signal on the other side into the sound reverberation signal on the other side.

With reference to the third aspect or any one of the first to the fifth possible implementation manners, a sixth possible implementation manner of the third aspect of this application is the processor, and the processor is further configured to summate all of the sound input signals on the one side and all of the filtered signals on the other side to obtain a synthetic signal, and the timbre equalization unit is configured to perform, using a fourth-order IIR filter, timbre equalization on the synthetic signal and then use the timbre-equalized synthetic signal as the virtual stereo signal.

By means of the foregoing solutions, in this application, ratio processing is performed on left-ear and right-ear components of preset HRTF data of each sound input signal on the other side, to obtain a filtering function that retains orientation information of the preset HRTF data such that during synthesis of a virtual stereo, convolution filtering processing needs to be performed on only the sound input signal on the other side using the filtering function, and then the sound input signal on the other side and an original sound input signal on one side are synthesized to obtain the virtual stereo, without a need to simultaneously perform convolution filtering on the sound input signals that are on the two sides, which greatly reduces calculation complexity, and during synthesis, convolution processing does not need to be performed on the sound input signal on one of the sides, and therefore an original audio is retained, which further alleviates a coloration effect, and improves sound quality of the virtual stereo.

DESCRIPTION OF EMBODIMENTS

Descriptions are provided in the following with reference to the accompanying drawings and specific implementation manners.

Figure 1:
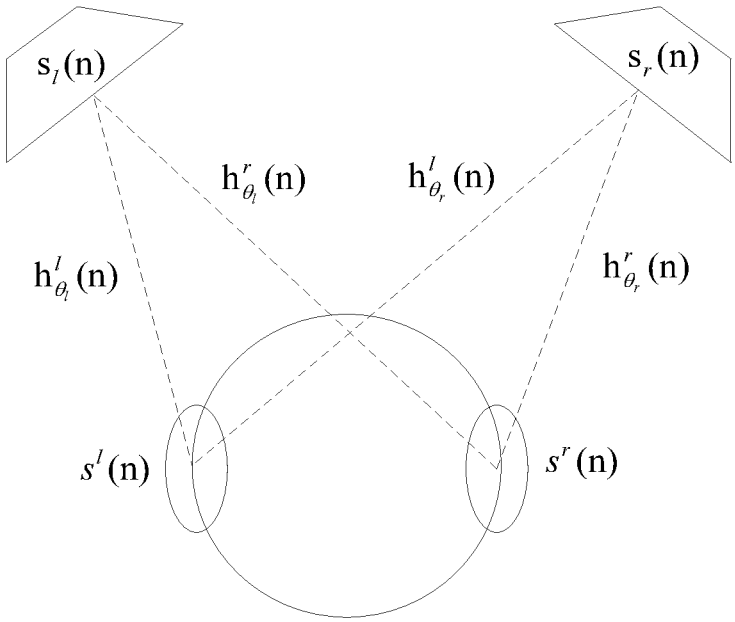
FIG. 1 a schematic diagram of synthesizing a virtual sound.
Figure 2:
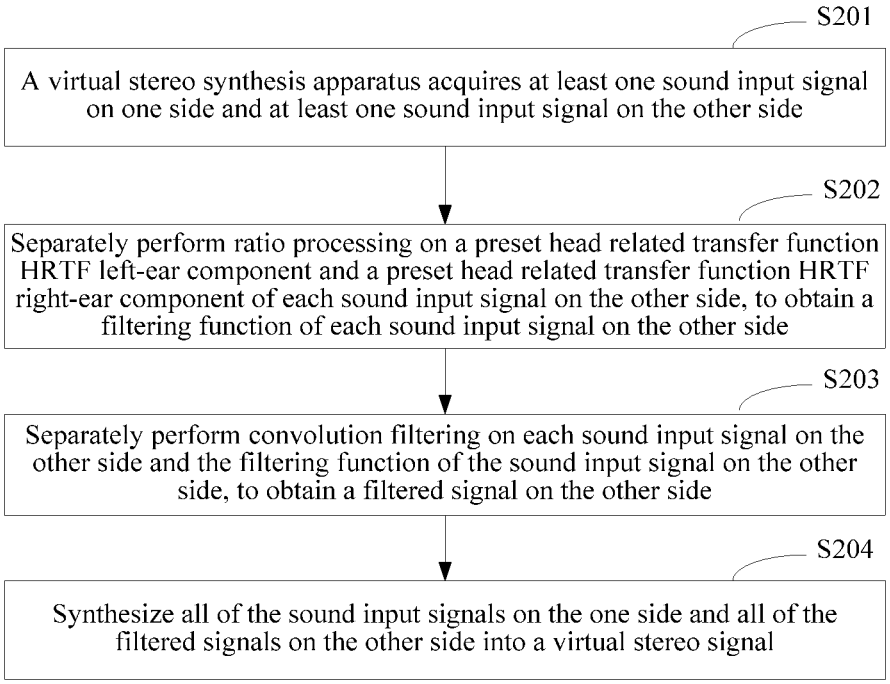
FIG. 2 is a flowchart of an implementation manner of a virtual stereo synthesis method according to this application.

Referring to FIG. 2, FIG. 2 is a flowchart of an implementation manner of a virtual stereo synthesis method according to this application. In this implementation manner, the method includes the following steps.

Step S201: A virtual stereo synthesis apparatus acquires at least one sound input signal $s_{1_m}(n)$ on one side and at least one sound input signal $s_{2_k}(n)$ on the other side.

In the present disclosure, an original sound signal is processed to obtain an output sound signal that has a stereo sound effect. In this implementation manner, there are a total of M simulated sound sources located on one side, which accordingly generate M sound input signals on the one side, and there are a total of K simulated sound sources located on the other side, which accordingly generate K sound input signals on the other side. The virtual stereo synthesis apparatus acquires the M sound input signals $s_{1_m}(n)$ on the one side and the K sound input signals $s_{2_k}(n)$ on the other side, where the M sound input signals $s_{1_k}(n)$ on the one side and the K sound input signals $s_{2_k}(n)$ on the other side are used as original sound signals, where $s_{1_m}(n)$ represents the $m^{th}$ sound input signal on the one side, $s_{2_k}(n)$ represents the $k^{th}$ sound input signal on the other side, $1 \le m \le M$, and $1 \le k \le K$.

Generally, in the present disclosure, the sound input signals on the one side and the other side simulate sound signals that are sent from left side and right side positions of an artificial head center in order to be distinguished from each other. For example, if the sound input signal on the one side is a left-side sound input signal, the sound input signal on the other side is a right-side sound input signal, or if the sound input signal on the one side is a right-side sound input signal, the sound input signal on the other side is a left-side sound input signal, where the left-side sound input signal is a simulation of a sound signal that is sent from the left side position of the artificial head center, and the right-side sound input signal is a simulation of a sound signal that is sent from the right side position of the artificial head center. For example, in a dual-channel mobile terminal, a left channel signal is a left-side sound input signal, and a right channel signal is a right-side sound input signal. When a sound is played by a headset, the virtual stereo synthesis apparatus separately acquires the left and right channel signals that are used as original sound signals, and separately uses the left and the right channel signals as the sound input signals on the one side and the other side. Alternatively, for some mobile terminals whose replay signal sources include four channel signals, horizontal angles between simulated sound sources of the four channel signals and the front of the artificial head center are separately ±30° and ±110°, and elevation angles of the simulated sound sources are 0°. It is generally defined that, channel signals whose horizontal angles are positive angles (+30° and +110°) are right-side sound input signals, and channel signals whose horizontal angles are negative angles (−30° and −110°) are left-side sound input signals. When a sound is played by a headset, the virtual stereo synthesis apparatus acquires the left-side and right-side sound input signals that are separately used as the sound input signals on the one side and the other side.

Step S202: The virtual stereo synthesis apparatus separately performs ratio processing on a preset function HRTF left-ear component $h_{\theta_k,\phi_k}^{l}(n)$ and a preset HRTF right-ear component $h_{\theta_k,\phi_k}^{r}(n)$ of each sound input signal $s_{2_k}(n)$ on the other side, to obtain a filtering function $h_{\theta_k,\phi_k}^{c}(n)$ of each sound input signal on the other side.

A preset HRTF is briefly described herein, HRTF data $h_{\theta,\phi}(n)$ is filter model data, measured in a laboratory, of transmission paths that are from a sound source at a position to two ears of an artificial head, and expresses a comprehensive filtering function of a human physiological structure on a sound wave from the position of the sound source, where a horizontal angle between the sound source and the artificial head center is θ, and an elevation angle between the sound source and the artificial head center is ϕ. Different HRTF experimental measurement databases can already be provided in the prior art. In the present disclosure, HRTF data of a preset sound source may be directly acquired, without performing measurement, from the HRTF experimental measurement databases in the prior art, and a simulated sound source position is a sound source position during measurement of corresponding preset HRTF data. In this implementation manner, each sound input signal correspondingly comes from a different preset simulated sound source, and therefore a different piece of HRTF data is correspondingly preset for each sound input signal. The preset HRTF data of each sound input signal can express a filtering effect on the sound input signal that is transmitted from a preset position to the two ears. Furthermore, preset HRTF data $h_{\theta_k,\phi_k}(n)$ of the $k^{th}$ sound input signal on the other side includes two pieces of data, which are respectively a left-ear component $h_{\theta_k,\phi_k}^{l}(n)$ that expresses a filtering effect on the sound input signal that is transmitted to the left ear of the artificial head and a right-ear component $h_{\theta_k,\phi_k}^{r}(n)$ that expresses a filtering effect on the sound input signal that is transmitted to the right ear of the artificial head.

The virtual stereo synthesis apparatus performs ratio processing on the left-ear component $h_{\theta_k,\phi_k}^{l}(n)$ and the right-ear component $h_{\theta_k,\phi_k}^{r}(n)$ in preset HRTF data of each sound input signal $s_{2_k}(n)$ on the other side, to obtain the filtering function $h_{\theta_k,\phi_k}^{c}(n)$ of each sound input signal on the other side, for example, the virtual stereo synthesis apparatus directly transforms the preset HRTF left-ear component and the preset HRTF right-ear component of the sound input signal on the other side to frequency domain, performs a ratio operation to obtain a value, and uses the obtained value as the filtering function of the sound input signal on the other side, or the virtual stereo synthesis apparatus first transforms the preset HRTF left-ear component and the preset HRTF right-ear component of the sound input signal on the other side to frequency domain, performs subband smoothing, then performs a ratio operation to obtain a value, and uses the obtained value as the filtering function.

Step S203: The virtual stereo synthesis apparatus separately performs convolution filtering on each sound input signal $s_{2_k}(n)$ on the other side and the filtering function $h_{\theta_k,\phi_k}^{c}(n)$ of the sound input signal on the other side, to obtain the filtered signal $s_{2_k}^{h}(n)$ on the other side.

The virtual stereo synthesis apparatus calculates the filtered signal $s_{2_k}^{h}(n)$ on the other side corresponding to each sound input signal $s_{2_k}(n)$ on the other side according to a formula $s_{2_k}^{h}(n)=\mathrm{conv}(h_{\theta_k,\phi_k}^{c}(n), s_{2_k}(n))$, where conv(x, y) represents a convolution of vectors x and y, $s_{2_k}^{h}(n)$ represents the $k^{th}$ filtered signal on the other side, $h_{\theta_k,\phi_k}^{c}(n)$ represents a filtering function of the $k^{th}$ sound input signal on the other side, and $s_{2_k}(n)$ represents the $k^{th}$ sound input signal on the other side.

Step S204: The virtual stereo synthesis apparatus synthesizes all of the sound input signals $s_{1_m}(n)$ on the one side and all of the filtered signals $s_{2_k}^{h}(n)$ on the other side into a virtual stereo signal $s^1(n)$.

The virtual stereo synthesis apparatus synthesizes, according to $$s^1(n) = \sum_{m=1}^{M} s_{1_m}(n) + \sum_{k=1}^{K} s_{2_k}^{h}(n),$$

all of the sound input signals $s_{1_m}(n)$ on the one side that are obtained in step S201 and all of the filtered signals $s_{2_k}^{h}(n)$ on the other side that are obtained in step S203 into the virtual stereo signal $s^1$ (n).

In this implementation manner, ratio processing is performed on left-ear and right-ear components of preset HRTF data of each sound input signal on the other side, to obtain a filtering function that retains orientation information of the preset HRTF data such that during synthesis of a virtual stereo, convolution filtering processing needs to be performed on only the sound input signal on the other side using the filtering function, and the sound input signal on the other side and a sound input signal on one side are synthesized to obtain the virtual stereo, without a need to simultaneously perform convolution filtering on the sound input signals that are on the two sides, which greatly reduces calculation complexity, and during synthesis, convolution processing does not need to be performed on the sound input signal on the one side, and therefore an original audio is retained, which further alleviates a coloration effect, and improves sound quality of the virtual stereo.

It should be noted that, in this implementation manner, the generated virtual stereo is a virtual stereo that is input to an ear on one side, for example, if the sound input signal on the one side is a left-side sound input signal, and the sound input signal on the other side is a right-side sound input signal, the virtual stereo signal obtained according to the foregoing steps is a left-ear virtual stereo signal that is directly input to the left ear, or if the sound input signal on the one side is a right-side sound input signal, and the sound input signal on the other side is a left-side sound input signal, the virtual stereo signal obtained according to the foregoing steps is a right-ear virtual stereo signal that is directly input to the right ear. In the foregoing manner, the virtual stereo synthesis apparatus can separately obtain a left-ear virtual stereo signal and a right-ear virtual stereo signal, and output the signals to the two ears using a headset, to achieve a stereo effect that is like a natural sound.

In addition, in an implementation manner in which positions of virtual sound sources are all fixed, it is not limited that the virtual stereo synthesis apparatus executes step S202 each time virtual stereo synthesis is performed (for example, each time replay is performed using a headset). HRTF data of each sound input signal indicates filter model data of paths for transmitting the sound input signal from a sound source to two ears of an artificial head, and in a case in which a position of the sound source is fixed, the filter model data of the path for transmitting the sound input signal, generated by the sound source, from the sound source to the two ears of the artificial head is fixed. Therefore, step S202 may be separated out, and step 202 is executed in advance to acquire and save a filtering function of each sound input signal, and when the virtual stereo synthesis is performed, the filtering function, saved in advance, of each sound input signal is directly acquired to perform convolution filtering on a sound input signal on the other side generated by a virtual sound source on the other side. The foregoing case still falls within the protection scope of the virtual stereo synthesis method in the present disclosure.

Figure 3:
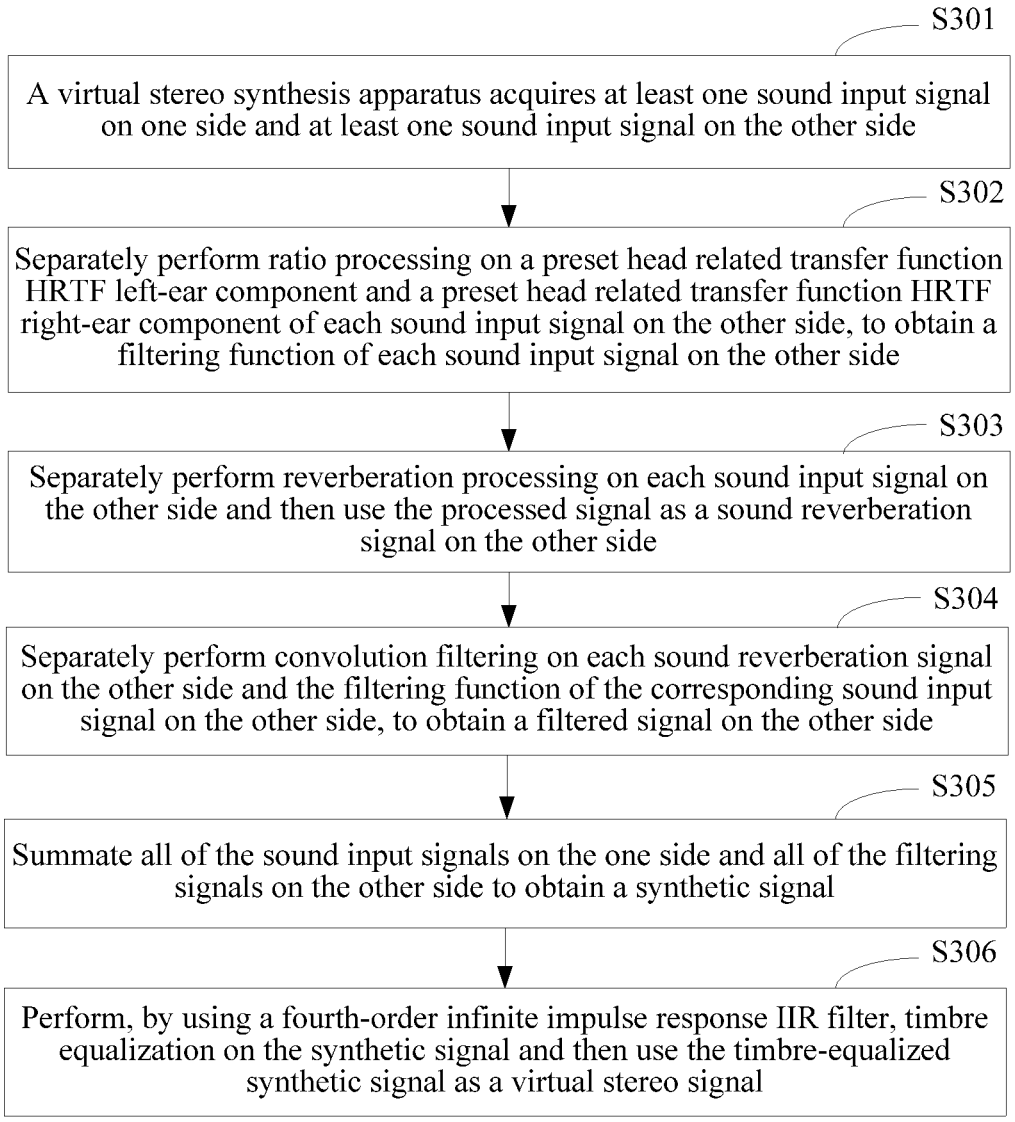
FIG. 3 is a flowchart of another implementation manner of a virtual stereo synthesis method according to this application.

Referring to FIG. 3, FIG. 3 is a flowchart of another implementation manner of a virtual stereo synthesis method according to the present disclosure. In this implementation manner, the method includes the following steps.

Step S301: A virtual stereo synthesis apparatus acquires at least one sound input signal $s_{1_m}(n)$ on one side and at least one sound input signal $s_{2_k}(n)$ on the other side.

The virtual stereo synthesis apparatus acquires the at least one sound input signal $s_{1_m}(n)$ on the one side and the at least one sound input signal $s_{2_k}(n)$ on the other side, where $s_{1_m}(n)$ represents the $m^{th}$ sound input signal on the one side, $s_{2_k}(n)$ represents the $k^{th}$ sound input signal on the other side. In this implementation manner, there are a total of M sound input signals on the one side, and there are a total of K sound input signals on the other side, $1 \le m \le M$, and $1 \le k \le K$.

Step S302: Separately perform ratio processing on a preset HRTF left-ear component $h_{\Theta_k,\Phi_k}{}^{l}(n)$ and a preset function HRTF right-ear component $h_{\Theta_k,\Phi_k}{}^{r}(n)$ of each sound input signal $s_{2_k}(n)$ on the other side, to obtain a filtering function $h_{\Theta_k,\Phi_k}{}^{c}(n)$ of each sound input signal on the other side.

The virtual stereo synthesis apparatus performs ratio processing on the left-ear component $h_{\Theta_k,\Phi_k}{}^{l}(n)$ and the right-ear component $h_{\Theta_k,\Phi_k}{}^{r}(n)$ in preset HRTF data of each sound input signal $s_{2_k}(n)$ on the other side, to obtain a filtering function $h_{\Theta_k,\Phi_k}{}^{c}(n)$ of each sound input signal on the other side.

Figure 4:
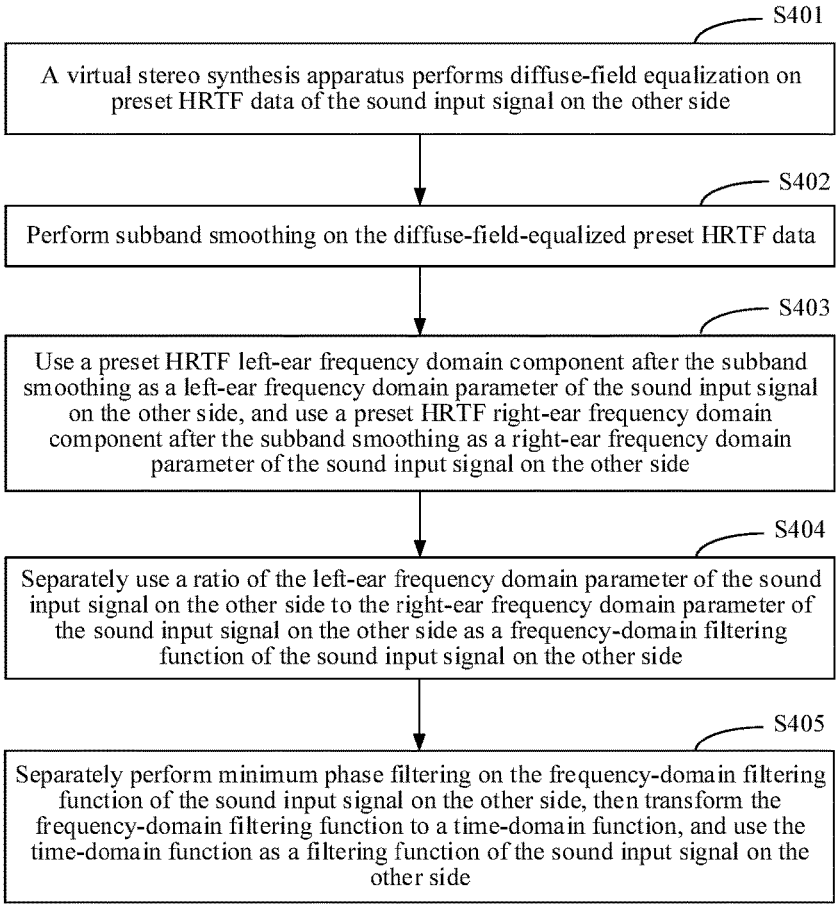
FIG. 4 is a flowchart of a method for obtaining a filtering function $h_{\theta_k,\Phi_k}{}^{c}(n)$ of a sound input signal on the other side in step S302 shown in FIG. 3.

A specific method for obtaining the filtering function of each sound input signal on the other side is described using an example. Referring to FIG. 4, FIG. 4 is a flowchart of a method for obtaining the filtering function $h_{\Theta_k,\Phi_k}{}^{c}(n)$ of the sound input signal on the other side in step S302 shown in FIG. 3. Acquiring, by the virtual stereo synthesis apparatus, the filtering function $h_{\Theta_k,\Phi_k}{}^{c}(n)$ of each sound input signal on the other side includes the following steps.

Step S401: The virtual stereo synthesis apparatus performs diffuse-field equalization on preset HRTF data $h_{\Theta_k,\Phi_k}(n)$ of the sound input signal on the other side.

A preset HRTF data of the $k^{th}$ sound input signal on the other side is represented by $h_{\Theta_k,\Phi_k}(n)$, where a horizontal angle between a simulated sound source of the $k^{th}$ sound input signal on the other side and an artificial head center is $\theta_k$, an elevation angle between the simulated sound source of the $k^{th}$ sound input signal on the other side and the artificial head center is $\phi_k$, and $h_{\Theta_k,\Phi_k}(n)$ includes two pieces of data: a left-ear component $h_{\Theta_k,\Phi_k}{}^{l}(n)$ and a right-ear component $h_{\Theta_k,\Phi_k}{}^{r}(n)$. Generally, a preset HRTF data obtained by means of measurement in a laboratory not only includes filter model data of transmission paths from a speaker, used as a sound source, to two ears of an artificial head, but also includes interference data such as a frequency response of the speaker, a frequency response of microphones that are disposed at the two ears to receive a signal of the speaker, and a frequency response of an ear canal of an artificial ear. These interference data affects a sense of orientation and a sense of distance of a synthetic virtual sound. Therefore, in this implementation manner, an optimal manner is used, in which the foregoing interference data is eliminated by means of diffuse-field equalization.

(1) Furthermore, it is calculated that a frequency domain of the preset HRTF data $h_{\Theta_k,\Phi_k}(n)$ of the sound input signal on the other side is $H_{\Theta_k,\Phi_k}(n)$.

(2) An average energy spectrum DF _avg(n), in all directions, of the preset HRTF data frequency domain $H_{\Theta_k,\Phi_k}(n)$ of the sound input signal on the other side is calculated:

$$\mathrm{DF_avg}(n) = \frac{1}{(2*T*P)} \sum_{\varphi_k=\varphi_1}^{\varphi_P} \sum_{\theta_k=\theta_1}^{\theta_T} |H_{\theta_k,\varphi_k}(n)|^2,$$

where $|H_{\Theta_k,\Phi_k}(n)|$ represents a modulus of $H_{\Theta_k,\Phi_k}(n)$, P and T represent a quantity P of elevation angles between test sound sources and an artificial head center, and a quantity T of horizontal angles between the test sound sources and the artificial head center, where P and T are included in an HRTF experimental measurement database in which $H_{\Theta_k,\Phi_k}(n)$ is located. In the present disclosure, when HRTF data in different HRTF experimental measurement databases is used, the quantity P of elevation angles and the quantity T of horizontal angles may be different.

(3) The average energy spectrum DF _avg(n) is inversed, to obtain an inversion DF _inv(n) of the average energy spectrum of the preset HRTF data frequency domain $H_{\Theta_k,\Phi_k}(n)$:

$$\mathrm{DF_inv}(n) = \frac{1}{\mathrm{DF_avg}(n)}.$$

(4) The inversion DF _inv(n) of the average energy spectrum of the preset HRTF data frequency domain $H_{\Theta_k,\Phi_k}(n)$ is transformed to time domain, and a real value is taken, to obtain an average inverse filtering sequence df _inv(n) of the preset HRTF data:

$$\mathrm{df_inv}(n)=\mathrm{real}(\mathrm{InvFT}(\mathrm{DF_inv}(n))),$$

where InfFT( ) represents inverse Fourier transform, and real(x) represents calculation of a real number part of a complex number x.

(5) Convolution is performed on the preset HRTF data $h_{\Theta_k,\Phi_k}(n)$ of the sound input signal on the other side and the average inverse filtering sequence df _inv(n) of the preset HRTF data, to obtain diffuse-field-equalized preset HRTF data $\bar{h}_{\Theta_k,\Phi_k}(n)$:

$$\bar{h}_{\Theta_k,\Phi_k}(n)=\mathrm{conv}(h_{\Theta_k,\Phi_k}(n),\mathrm{df_inv}(n)),$$

where conv(x,y) represents a convolution of vectors x and y, and $\bar{h}_{\Theta_k,\Phi_k}(n)$ includes a diffuse-field-equalized preset HRTF left-ear component $\bar{h}_{\Theta_k,\Phi_k}{}^{l}(n)$ and a diffuse-field-equalized preset HRTF right-ear component $\bar{h}_{\Theta_k,\Phi_k}{}^{r}(n)$.

The virtual stereo synthesis apparatus performs the foregoing processing (1) to (5) on the preset HRTF data $h_{\Theta_k,\Phi_k}(n)$ of the sound input signal on the other side, to obtain the diffuse-field-equalized HRTF data $\bar{h}_{\Theta_k,\Phi_k}(n)$.

Step S402: Perform subband smoothing on the diffuse-field-equalized preset HRTF data $\bar{h}_{\Theta_k,\Phi_k}(n)$.

The virtual stereo synthesis apparatus transforms the diffuse-field-equalized preset HRTF data $\bar{h}_{\Theta_k,\Phi_k}(n)$ to frequency domain, to obtain a frequency domain $\bar{H}_{\Theta_k,\Phi_k}(n)$ of the diffuse-field-equalized preset HRTF data. A time-domain transformation length of $\bar{h}_{\Theta_k,\Phi_k}(n)$ is $N_1$, and a quantity of frequency domain coefficients of $\bar{H}_{\Theta_k,\Phi_k}(n)$ is $N_2$, where $N_2=N1/2+1$.

The virtual stereo synthesis apparatus performs subband smoothing on the frequency domain $\bar{H}_{\Theta_k,\Phi_k}(n)$ of the diffuse-field-equalized preset HRTF data, calculates a modulus, and uses frequency domain data as subband-smoothed preset HRTF data $|\hat{H}_{\theta_k,\Phi_k}(n)|$:

$$|\hat{H}_{\theta_k,\varphi_k}(n)| = \frac{1}{\sum_{j=1}^{j_{max}-j_{min}+1} hann(j)} \sum_{j=j_{min}}^{j_{max}} |\overline{H}_{\theta_k,\varphi_k}(j) * hann(j - j_{min} + 1)|,$$

where $$j_{min} = \begin{cases} n - bw(n) & n - bw(n) > 1 \\ 1 & n - bw(n) \le 1 \end{cases}, \quad j_{max} = \begin{cases} n + bw(n) & n + bw(n) > M \\ M & n + bw(n) \le M \end{cases}$$

$bw(n)=\lfloor 0.2*n \rfloor$, $\lfloor x \rfloor$ represents a maximum integer that is not greater than x, and $hann(j)=0.5*(1-\cos(2*\pi*j/(2*bw(n)+1)))$, $j=0 \ldots (2*bw(n)+1)$.

Step S403: Use a preset HRTF left-ear frequency domain component $\hat{H}_{\theta_k,\Phi_k}{}^{l}(n)$ after the subband smoothing as a left-ear frequency domain parameter of the sound input signal on the other side, and use a preset HRTF right-ear frequency domain component $\hat{H}_{\theta_k,\Phi_k}{}^{r}(n)$ after the subband smoothing as a right-ear frequency domain parameter of the sound input signal on the other side. The left-ear frequency domain parameter represents a preset HRTF left-ear component of the sound input signal on the other side, and the right-ear frequency domain parameter represents a preset HRTF right-ear component of the sound input signal on the other side. Certainly, in another implementation manner, the preset HRTF left-ear component of the sound input signal on the other side may be directly used as the left-ear frequency domain parameter, or the preset HRTF left-ear component that has been subject to diffuse-field equalization may be used as the left-ear frequency domain parameter. It is similar for the right-ear frequency domain parameter.

Step S404: Separately use a ratio of the left-ear frequency domain parameter of the sound input signal on the other side to the right-ear frequency domain parameter of the sound input signal on the other side as a frequency-domain filtering function $H_{\theta_k,\Phi_k}{}^{c}(n)$ of the sound input signal on the other side.

The ratio of the left-ear frequency domain parameter of the sound input signal on the other side to the right-ear frequency domain parameter of the sound input signal on the other side further includes a modulus ratio and an argument difference between the left-ear frequency domain parameter and the right-ear frequency domain parameter, where the modulus ratio and the argument difference are correspondingly used as a modulus and an argument in the frequency-domain filtering function of the sound input signal on the other side, and the obtained filtering function can retain orientation information of the preset HRTF left-ear component and the preset HRTF right-ear component of the sound input signal on the other side.

In this implementation manner, the virtual stereo synthesis apparatus performs a ratio operation on the left-ear frequency domain parameter and the right-ear frequency domain parameter of the sound input signal on the other side. Further, the modulus of the frequency-domain filtering function $H_{\theta_k,\Phi_k}{}^{c}(n)$ of the sound input signal on the other side is obtained according to $$|H^{c}_{\theta,\varphi_i}(n)| = \frac{|\hat{H}^{l}_{\theta,\varphi_i}(n)|}{|\hat{H}^{r}_{\theta,\varphi_i}(n)|},$$

the argument of the frequency-domain filtering function $H_{\theta_k,\Phi_k}{}^{c}(n)$ is obtained according to $\arg(H_{\theta,\Phi_i}{}^{c}(n))=\arg(\overline{H}_{\theta,\Phi_i}{}^{l}(n))-\arg(\overline{H}_{\theta,\Phi_i}{}^{r}(n))$, and therefore the frequency-domain filtering function $H_{\theta_k,\Phi_k}{}^{c}(n)$ of the sound input signal on the other side is obtained. $|\hat{H}_{\theta_k,\Phi_k}(n)|$ and $|\hat{H}_{\theta_k,\Phi_k}{}^{r}(n)|$ respectively represent a left-ear component and a right-ear component of the subband-smoothed preset HRTF data $|\hat{H}_{\theta_k,\Phi_k}(n)|$, and $\overline{H}_{\theta_k,\Phi_k}{}^{l}(n)$ and $\overline{H}_{\theta_k,\Phi_k}(n)$ respectively represent a left-ear component and a right-ear component of the frequency domain $\overline{H}_{\theta_k,\Phi_k}(n)$ of the diffuse-field-equalized preset HRTF data. In subband smoothing, only a modulus value of a complex number is processed, that is, a value obtained after subband smoothing is the modulus value of the complex number, and does not include argument information. Therefore, when the argument of the frequency-domain filtering function is calculated, a frequency domain parameter that can represent the preset HRTF data and that includes argument information needs to be used, for example, left and right components of a diffuse-field-equalized HRTF data.

It should be noted that, in the foregoing description, when diffuse-field equalization and subband smoothing are performed, the preset HRTF data $h_{\theta_k,\Phi_k}(n)$ is processed. However, the preset HRTF data $h_{\theta_k,\Phi_k}(n)$ includes two pieces of data: the left-ear component and the right-ear component, and therefore in fact, it is equivalent to that the diffuse-field equalization and the subband smoothing are performed separately on the left-ear component and the right-ear component of a preset HRTF data.

Step S405: Separately perform minimum phase filtering on the frequency-domain filtering function $H_{\theta_k,\Phi_k}{}^{c}(n)$ of the sound input signal on the other side, then transform the frequency-domain filtering function to a time-domain function, and use the time-domain function as a filtering function $h_{\theta_k,\Phi_k}{}^{c}(n)$ of the sound input signal on the other side.

The obtained frequency-domain filtering function $H_{\theta_k,\Phi_k}{}^{c}(n)$ may be expressed as a position-independent delay plus a minimum phase filter. Minimum phase filtering is performed on the obtained frequency-domain filtering function $H_{\theta_k,\Phi_k}{}^{c}(n)$ in order to reduce a data length and reduce calculation complexity during virtual stereo synthesis, and additionally, a subjective instruction is not affected.

(1) The virtual stereo synthesis apparatus extends the modulus of the obtained frequency-domain filtering function $H_{\theta_k,\Phi_k}{}^{c}(n)$ to a time-domain transformation length $N_1$ thereof, and calculates a logarithmic value:

$$|\overline{H}^{c}_{\theta_k,\varphi_k}(n)| = \begin{cases} -\ln(|H^{c}_{\theta_k,\varphi_k}(n)|) & n \le N_2 \\ -\ln(|H^{c}_{\theta_k,\varphi_k}(N_1 - n + 1)|) & N_2 < n \le N_1 \end{cases},$$

where $\ln(x)$ is a natural logarithm of x, $N_1$ is a time-domain transformation length of a time domain $h_{\theta_k,\Phi_k}{}^{c}(n)$ of the frequency-domain filtering function, and $N_2$ is a quantity of frequency domain coefficients of the frequency-domain filtering function $H_{\theta_k,\Phi_k}{}^{c}(n)$.

(2) Hilbert transform is performed on the modulus $|H_{\theta_k,\Phi_k}{}^{c}(n)|$, in (1), of the obtained frequency-domain filtering function:

$$H_{\theta_k,\Phi_k}{}^{H}(n)=\text{Hilbert}(|\overline{H}_{\theta_k,\Phi_k}{}^{c}|),$$

where Hilbert( ) represents Hilbert transform.

(3) A minimum phase filter $H_{\Theta_k,\Phi_k}^{mp}(n)$ is obtained:

$$H_{\theta_k,\varphi_k}^{mp}(n) = |H_{\theta_k,\varphi_k}^{c}(n)|\, e^{i*H_{\theta_k,\varphi_k}^{H}(n)},$$

where n=1 . . . $N_2$.

(4) A delay $\tau(\theta_k,\phi_k)$ is calculated:

$$\tau(\theta_k, \varphi_k) = -\left[\frac{fs}{k_{max}^{itd} - k_{min}^{itd} + 1} \sum_{k=k_{min}^{itd}}^{k_{max}^{itd}} \frac{\arg\left(H_{\theta_k,\varphi_k}^{c}(k)\right) - H_{\theta_k,\varphi_k}^{H}(k)}{\pi * fs * \frac{k}{N_2 - 1}}\right].$$

(5) The minimum phase filter $H_{\Theta_k,\Phi_k}^{mp}(n)$ is transformed to time domain, to obtain $h_{\Theta_k,\Phi_k}^{mp}(n)$:

$$h_{\Theta_k,\Phi_k}^{mp}(n)=\text{real}(\text{InvFT}(H_{\Theta_k,\Phi_k}^{mp}(n))),$$

where InvFT( ) represents inverse Fourier transform, and real( ) represents a real number part of a complex number x.

(6) The time domain $h_{\Theta_k,\Phi_k}^{mp}(n)$ of the minimum phase filter is truncated according to a length $N_0$, and the delay $\tau(\theta_k, \phi_k)$ is added:

$$h_{\theta_k,\varphi_k}^{c}(n) = \begin{cases} 0 & 1 \le n \le \tau(\theta_k, \varphi_k) \\ h_{\theta_k,\varphi_k}^{mp}(n - \tau(\theta_k, \varphi_k)) & \tau(\theta_k, \varphi_k) < n \le \tau(\theta_k, \varphi_k) + N_0 \end{cases}.$$

Relatively large coefficients of the minimum phase filter $H_{\Theta_k,\Phi_k}^{mp}(n)$ obtained in (3) are concentrated in the front, and after relatively small coefficients in the rear are removed by means of truncation, a filtering effect does not change greatly. Therefore, generally, to reduce calculation complexity, the time domain $h_{\Theta_k,\Phi_k}^{mp}(n)$ of the minimum phase filter is truncated according to the length $N_0$, where a value of the length $N_0$ may be selected according to the following steps. The time domain $h_{\Theta_k,\Phi_k}^{mp}(n)$ of the minimum phase filter is sequentially compared, from the rear to the front, with a preset threshold e. A coefficient less than e is removed, and the comparison is continued to be performed on a coefficient prior to the removed coefficient, and is stopped until a coefficient is greater than e, where a total length of remaining coefficients is $N_0$, and the preset threshold e may be 0.01.

A tailored filtering function $h_{\Theta_k,\Phi_k}^{c}(n)$ is finally obtained according to steps S401 to 405 above, to be used as the filtering function of the sound input signal on the other side.

It should be noted that, the foregoing example of obtaining the filtering function $h_{\Theta_k,\Phi_k}^{c}(n)$ of the sound input signal on the other side is used as an optimal manner, in which diffuse-field equalization, subband smoothing, ratio calculation, and the minimum phase filtering is performed in sequence on the left-ear component $h_{\Theta_k,\Phi_k}^{l}(n)$ and the right-ear component $h_{\Theta_k,\Phi_k}^{r}(n)$ of the preset HRTF data of the sound input signal on the other side, to obtain the filtering function $h_{\Theta_k,\Phi_k}^{c}(n)$ of the sound input signal on the other side. However, in another implementation manner, the left-ear component $h_{\Theta_k,\Phi_k}^{l}(n)$ and the right-ear component $h_{\Theta_k,\Phi_k}^{r}(n)$ of the preset HRTF data of the sound input signal on the other side may also be separately used as the left-ear frequency domain parameter and the right-ear frequency domain parameter directly, and then ratio calculation is performed according to a formula $$|H_{\theta_k,\varphi_k}^{c}| = \frac{|H_{\theta_k,\varphi_k}^{l}(n)|}{|H_{\theta_k,\varphi_k}^{r}(n)|}$$

$\arg(H_{\Theta_k,\Phi_k}^{c}(n))=\arg(H_{\Theta_k,\Phi_k}^{l}(n))-\arg(H_{\Theta_k,\Phi_k}^{r}(n))$, to obtain the frequency-domain filtering function $H_{\Theta_k,\Phi_k}^{c}(n)$ of the sound input signal on the other side, and the frequency-domain filtering function is transformed to time domain to obtain the filtering function $h_{\Theta_k,\Phi_k}^{c}(n)$ of the sound input signal on the other side, or, the left-ear component $\overline{H}_{\Theta_k,\Phi_k}^{l}(n)$ and the right-ear component $\overline{H}_{\Theta_k,\Phi_k}^{r}(n)$ of a diffuse-field-equalized preset HRTF data are transformed to frequency domain, and then are separately used as the left-ear frequency domain parameter $\overline{H}_{\Theta_k,\Phi_k}^{l}(n)$ and the right-ear frequency domain parameter $\overline{H}_{\Theta_k,\Phi_k}^{r}(n)$, ratio calculation is performed according to a $$|H_{\theta_k,\varphi_k}^{c}| = \frac{|\overline{H}_{\theta_k,\varphi_k}^{l}(n)|}{|\overline{H}_{\theta_k,\varphi_k}^{r}(n)|}$$

formula $\arg(H_{\Theta_k,\Phi_k}^{c}(n))=\arg(\overline{H}_{\Theta_k,\Phi_k}^{l}(n))-\arg(\overline{H}_{\Theta_k,\Phi_k}^{r}(n))$, to obtain the frequency-domain filtering function $H_{\Theta_k,\Phi_k}^{c}(n)$, and the frequency-domain filtering function is transformed to time domain to obtain the filtering function $h_{\Theta_k,\Phi_k}^{c}(n)$ of the sound input signal on the other side, or, subband smoothing is directly performed on the preset HRTF data of the sound input signal on the other side according to $$|\hat{H}_{\theta_k,\varphi_k}(n)| = \frac{1}{\sum_{j=1}^{j_{max}-j_{min}+1} hann(j)} \sum_{j=j_{min}}^{j_{max}} |H_{\theta_k,\varphi_k}(j) * hann(j - j_{min} + 1)|,$$

the left-ear component and the right-ear component of the subband-smoothed preset HRTF data are separately used as the left-ear frequency domain parameter and the right-ear frequency domain parameter, ratio calculation is performed according to a formula $$|H_{\theta,\varphi_i}^{c}(n)| = \frac{|\hat{H}_{\theta,\varphi_i}^{l}(n)|}{|\hat{H}_{\theta,\varphi_i}^{r}(n)|}$$

$\arg(H_{\Theta_k,\Phi_k}^{c}(n))=\arg(H_{\Theta_k,\Phi_k}^{l}(n))-\arg(H_{\Theta_k,\Phi_k}^{r}(n))$, and minimum phase filtering is performed, to obtain the filtering function $h_{\Theta_k,\Phi_k}^{c}(n)$ of the minimum phase filtering. The step subband smoothing in step S402 is generally set together with the step of minimum phase filtering in step S405, that is, if the step of minimum phase filtering is not performed, the step of subband smoothing is not performed. The step of subband smoothing is added before the step of minimum phase filtering, which further reduces the data length of the obtained filtering function $h_{\Theta_k,\Phi_k}^{c}(n)$ of the sound input signal on the other side, and therefore further reduces calculation complexity during virtual stereo synthesis.

Step S303: Separately perform reverberation processing on each sound input signal $s_{2_k}(n)$ on the other side and then use the processed signal as a sound reverberation signal $\hat{s}_{2_k}(n)$ on the other side.

Figure 5:
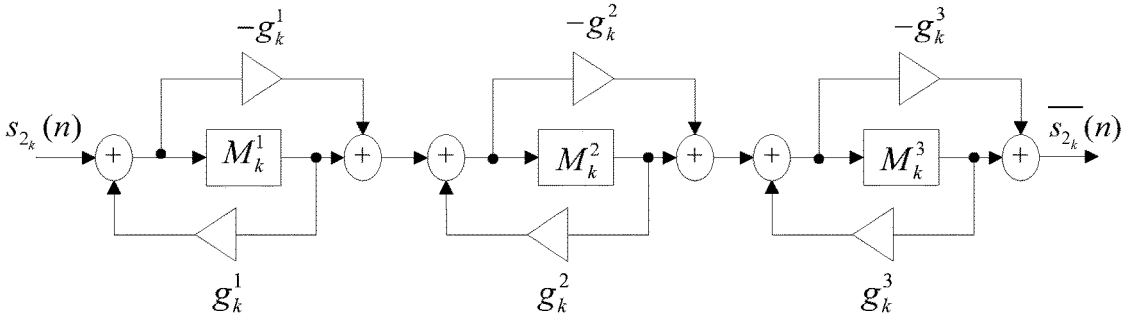
FIG. 5 is a schematic structural diagram of an all-pass filter used in step S303 shown in FIG. 3.

After acquiring the at least one sound input signal $s_{2_k}(n)$ on the other side, the virtual stereo synthesis apparatus separately performs reverberation processing on each sound input signal $s_{2_k}(n)$ on the other side, to enhance filtering effects such as environment reflection and scattering during actual sound broadcasting, and enhance a sense of space of the input signal. In this implementation manner, reverberation processing is implemented using an all-pass filter. Specifics are as follows:

(1) As shown in FIG. 5, filtering is performed on each sound input signal $s_{2_k}(n)$ on the other side using three cascaded Schroeder all-pass filters, to obtain a reverberation signal $\overline{s_{2_k}}(n)$ of each sound input signal $s_{2_k}(n)$ on the other side:

$$\overline{s_{2_k}}(n)=\mathrm{conv}(h_k(n),s_{2_k}(n-d_k)),$$

where conv(x,y) represents a convolution of vectors x and y, $d_k$ is a preset delay of the $k^{th}$ sound input signal on the other side, $h_k(n)$ is an all-pass filter of the $k^{th}$ sound input signal on the other side, and a transfer function thereof is $$H_k(z)=\frac{-g_k^1+z^{-M_k^1}}{1-g_k^1*z^{M_k^1}}*\frac{-g_k^2+z^{-M_k^2}}{1-g_k^2*z^{M_k^2}}*\frac{-g_k^3+z^{-M_k^3}}{1-g_k^3*z^{M_k^3}},$$

where $g_k^1$, $g_k^2$, and $g_k^3$ are preset all-pass filter gains corresponding to the $k^{th}$ sound input signal on the other side, and $M_k^1$, $M_k^2$, and $M_k^3$ are preset all-pass filter delays corresponding to the $k^{th}$ sound input signal on the other side.

(2) Separately add each sound input signal $s_{2_k}(n)$ on the other side to the reverberation signal $\overline{s_{2_k}}(n)$ of the sound input signal on the other side, to obtain the sound reverberation signal $s_{2_k}(n)$ on the other side corresponding to each sound input signal on the other side:

$$\hat{s}_{2_k}(n)=s_{2_k}(n)+w_k\overline{s}_{2_k}(n),$$

where $w_k$ is a preset weight of the reverberation signal $\overline{s}_{2_k}(n)$ of the $k^{th}$ sound input signal on the other side, and generally, a larger weight indicates a stronger sense of space of a signal but causes a greater negative effect (for example, an unclear voice or indistinct percussion music). In this implementation manner, a weight of the sound input signal on the other side is determined in the following manner a suitable value is selected in advance as the weight $w_k$ of the reverberation signal $\overline{s_{2_k}}(n)$ according to an experiment result, where the value enhances the sense of space of the sound input signal on the other side and does not cause a negative effect.

Step S304: Separately perform convolution filtering on each sound reverberation signal $\overline{s}_{2_k}(n)$ on the other side and the filtering function $h_{\theta,\phi_i}^{c}(n)$ of the corresponding sound input signal on the other side, to obtain a filtered signal $s_{2_k}^{h}(n)$ on the other side.

After separately performing reverberation processing on each of the at least one sound input signal on the other side to obtain the sound reverberation signal $\hat{s}_{2_k}(n)$ on the other side, the virtual stereo synthesis apparatus performs convolution filtering on each sound reverberation signal $\hat{s}_{2_k}(n)$ on the other side according to a formula $s_{2_k}^{h}(n)=\mathrm{conv}(h_{\theta_k,\phi_k}^{c}(n),\hat{s}_{2_k}(n))$, to obtain the filtered signal $S_{2_k}^{h}(n)$ on the other side, where $\hat{s}_{2_k}(n)$ represents the $k^{th}$ sound filtered signal on the other side, $h_{\theta_k,\phi_k}^{c}(n)$ represents a filtering function of the $k^{th}$ sound input signal on the other side, and $\hat{s}_{2_k}(n)$ represents the $k^{th}$ sound reverberation signal on the other side.

Step S305: Summate all of the sound input signals $s_{1_m}(n)$ on the one side and all of the filtered signals $s_{2_k}^{h}(n)$ on the other side to obtain a synthetic signal $s^{-1}(n)$ Furthermore, the virtual stereo synthesis apparatus obtains the synthetic signal $s^{-1}(n)$ corresponding to the one side according to a formula $$s^{-1}(n)=\sum_{m=1}^{M}s_{1_m}(n)+\sum_{k=1}^{K}s_{2_k}^{h}(n).$$

For example, if the sound input signal on the one side is a left-side sound input signal, a left-ear synthetic signal is obtained, or if the sound input signal on the one side is a right-side sound input signal, a right-ear synthetic signal is obtained.

Step S306: Perform, using a fourth-order IIR filter, timbre equalization on the synthetic signal $s^{-1}(n)$ and then use the timbre-equalized synthetic signal as a virtual stereo signal $s^1(n)$.

The virtual stereo synthesis apparatus performs timbre equalization on the synthetic signal $s^{-1}(n)$, to reduce a coloration effect, on the synthetic signal, from the convolution-filtered sound input signal on the other side. In this implementation manner, timbre equalization is performed using a fourth-order IIR filter eq(n). Furthermore, the virtual stereo signal $s^1(n)$ that is finally output to the ear on the one side is obtained according to a formula $s^1(n)=\mathrm{conv}(\mathrm{eq}(n),s^{-1}(n))$.

A transfer function of eq(n) is $$H(z)=\frac{b_1+b_2z^{-1}+b_3z^{-2}+b_4z^{-3}+b_5z^{-4}}{a_1+a_2z^{-1}+a_3z^{-2}+a_4z^{-3}+a_5z^{-4}},$$

$$\text{where}\quad \begin{array}{ll} b_1=1.24939117710166 & a_1=1 \\ b_2=-4.72162304562892 & a_2=-3.76394096632083 \\ b_3=6.69867047060726\ ,\ \text{and} & a_3=5.31938925722012\ . \\ b_4=-4.22811576299464 & a_4=-3.34508050090584 \\ b_5=1.00174331383529 & a_5=0.789702281674921 \end{array}$$

For better comprehension of practical use of the virtual stereo synthesis method of this application, descriptions are further provided using an example, in which a sound generated by a dual-channel terminal is replayed by a headset, where a left channel signal is a left-side sound input signal $s_l(n)$, and a right channel signal is a right-side sound input signal $s_r(n)$, where preset HRTF data of the left-side sound input signal $s_l(n)$ is $h_{\theta,\phi}^{l}(n)$ $h_{\theta,\phi}^{l}(n)$, and preset HRTF data of the right-side sound input signal $s_r(n)$ is $h_{\theta,\phi}^{r}(n)$.

A virtual stereo synthesis apparatus separately processes the preset HRTF data $h_{\theta,\phi}^{l}(n)$ of the left-side sound input signal and the preset HRTF data $h_{\theta,\phi}^{r}(n)$ of the right-side sound input signal separately according to steps S401 to S405 above, to obtain a tailored filtering function $h_{\theta,\phi}^{cl}(n)$ of the left-side sound input signal and a tailored filtering function $h_{\theta,\phi}^{cr}(n)$ of the right-side sound input signal. In this example, horizontal angles $\theta_l$ and $\theta_r$ of the preset HRTF data of the left and right channel signals are 90° and −90°, and elevation angles $\phi_l$ and $\theta_r$ of the preset HRTF data of the left and right channel signals are both 0°. That is, values of the horizontal angles of the filtering function of the left-side sound input signal are opposite numbers, and the elevation angles of the filtering function of the left-side sound input signal are the same. Therefore $h_{\theta,\phi}^{cl}(n)$ and $h_{\theta,\phi}^{cr}(n)$ are same functions.

The virtual stereo synthesis apparatus acquires the left-side sound input signal $s_l(n)$ as a sound input signal on one side, and the right-side sound input signal $s_r(n)$ as a sound input signal on the other side. The virtual stereo synthesis apparatus executes step S303 to perform reverberation processing on the right-side sound input signal. A reverberation signal $\overline{s_r}(n)$ of the right-side sound input signal is first obtained according to $\overline{s_r}(n)=\mathrm{conv}(h_r(n),s_r(n-d_r))$ and $$H_r(z)=\frac{-g_r^1+z^{-M_r^1}}{1-g_r^1*z^{M_r^1}}*\frac{-g_r^2+z^{-M_r^2}}{1-g_r^2*z^{M_r^2}}*\frac{-g_r^3+z^{-M_r^3}}{1-g_r^3*z^{M_r^3}},$$

and a right-side sound reverberation signal $\hat{s}_r(n)$ is obtained according to $\hat{s}_r(n)=s_r(n)+w_r\square\overline{s_r}(n)$. The virtual stereo synthesis apparatus executes steps S304 to S306 to obtain a left-ear virtual stereo signal $s^l(n)$. Similarly, the virtual stereo synthesis apparatus acquires the right-side sound input signal $S_r(n)$ as a sound input signal on one side, and the left-side sound input signal $s_l(n)$ as a sound input signal on the other side. The virtual stereo synthesis apparatus executes step S303 to perform reverberation processing on the left-side sound input signal. Further, a reverberation signal $\overline{s}_l(n)$ of the left-side sound input signal is first obtained according to $\overline{s}_l(n)=\mathrm{conv}(h_l(n),s_l(n-d_l))$ and $$H_l(z)=\frac{-g_l^1+z^{-M_l^1}}{1-g_l^1*z^{M_l^1}}*\frac{-g_l^2+z^{-M_l^2}}{1-g_l^2*z^{M_l^2}}*\frac{-g_l^3+z^{-M_l^3}}{1-g_l^3*z^{M_l^3}},$$

and a left-side sound reverberation signal $\hat{s}_l(n)$ is obtained according to $\hat{s}_l(n)=s_l(n)+w_l\square\overline{s_l}(n)$. The virtual stereo synthesis apparatus executes steps S304 to S306 to obtain a right-ear virtual stereo signal $s^r(n)$. The left-side sound input signal $s_l(n)$ is replayed by a left-side earphone, to enter the left ear of a user, and the right-ear virtual stereo signal $s^r(n)$ is replayed by a right-side earphone, to enter the right ear of the user, to form a stereo listening effect.

Values of constants in the foregoing example are:

$T=72$, $P=1$, $N=512$, $N_0=48$, $fs=44100$, $d_l=220$, $d_r=264$, $g_l^1=g_l^2=g_l^3=g_r^1=g_r^2=g_r^3=0.6$, $M_l^1=M_r^1=220$, $M_l^2=M_r^2=132$, $M_l^3=M_r^3=74$, $w_l=w_r=0.4225$, $\theta=45°$, and $\phi=0°$.

The values of the constants are numerical values that are obtained by means of multiple experiments and that provide an optimal replay effect for a virtual stereo signal. Certainly, in another implementation manner, other numerical values may also be used. The values of the constants in this implementation manner are not further limited herein.

In this implementation manner, which is used as an optimized implementation manner, steps S303, S304, S305, and S306 are executed to perform reverberation processing, convolution filtering operation, virtual stereo synthesis, and timbre equalization is performed in sequence, to finally obtain a virtual stereo. However, in another implementation manner, steps S303 and S306 may be selectively performed, for example, steps S303 and S306 are not executed, while convolution filtering is directly performed on the sound input signal on the other side using the filtering function of the sound input signal on the other side, to obtain the filtered signal $\hat{s}_{2_k}(n)$ on the other side, and steps S304 and S305 are executed to obtain the synthetic signal $s^{-1}(n)$ that is used as the final virtual stereo signal $s^l(n)$, or step S306 is not executed, while steps S303 to S305 are executed to perform reverberation processing, a convolution filtering operation, and synthesis to obtain the synthetic signal $s^{-l}(n)$, and the synthetic signal $s^{-l}(n)$ is used as the virtual stereo signal $s^{-l}(n)$, or step S303 is not executed, while step S304 is directly executed to perform convolution filtering on the sound input signal on the other side, to obtain the filtered signal $\hat{s}_l(n)$ on the other side, and steps S305 and S306 are executed to obtain the final virtual stereo signal $s^l(n)$.

In this implementation manner, reverberation processing is performed on a sound input signal on the other side, which enhances a sense of space of a synthetic virtual stereo, and during synthesis of a virtual stereo, timbre equalization is performed on the virtual stereo using a filter, which reduces a coloration effect. In addition, in this implementation manner, existing HRTF data is improved. Diffuse-field equalization is first performed on the HRTF data, to eliminate interference data from the HRTF data, and then a ratio operation is performed on a left-ear component and a right-ear component that are in the HRTF data, to obtain improved HRTF data in which orientation information of the HRTF data is retained, that is, a filtering function in this application such that corresponding convolution filtering needs to be performed on only the sound input signal on the other side, and then a virtual stereo with a relatively good replay effect can be obtained. Therefore, virtual stereo synthesis in this implementation manner is different from that in the prior art, in which the convolution filtering is performed on sound input signals on both sides, and therefore, calculation complexity is greatly reduced. Moreover, an original input signal is completely retained on one side, which reduces a coloration effect. Further, in this implementation manner, the filtering function is further processed by means of subband smoothing and minimum phase filtering, which reduces a data length of the filtering function, and therefore further reduces the calculation complexity.

Figure 6:
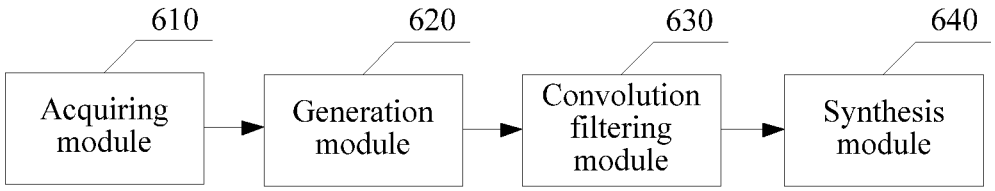
FIG. 6 is a schematic structural diagram of an implementation manner of a virtual stereo synthesis apparatus according to this application.

Referring to FIG. 6, FIG. 6 is a schematic structural diagram of an implementation manner of a virtual stereo synthesis apparatus according to this application. In this implementation manner, the virtual stereo synthesis apparatus includes an acquiring module 610, a generation module 620, a convolution filtering module 630, and a synthesis module 640.

The acquiring module 610 is configured to acquire at least one sound input signal $s_{1_m}(n)$ on one side and at least one sound input signal $s_{2_k}(n)$ on the other side, and send the at least one sound input signal on the one side and at least one sound input signal on the other side to the generation module 620 and the convolution filtering module 630.

In the present disclosure, an original sound signal is processed to obtain an output sound signal that has a stereo sound effect. In this implementation manner, there are a total of M simulated sound sources located on one side, which accordingly generate M sound input signals on the one side, and there are a total of K simulated sound sources located on the other side, which accordingly generate K sound input signals on the other side. The acquiring module 610 acquires the M sound input signals $s_{1_m}(n)$ on the one side and the K sound input signals $s_{2_k}(n)$ on the other side, where the M sound input signals $s_{1_m}(n)$ on the one side and the K sound input signals $s_{2_k}(n)$ on the other side are used as original sound signals, where $s_{1_m}(n)$ represents the $m^{th}$ sound input signal on the one side, $s_{2_k}(n)$ represents the $k^{th}$ sound input signal on the other side, $1\le m\le M$, and $1\le k\le K$.

Generally, in the present disclosure, the sound input signals on the one side and the other side simulate sound signals that are sent from left side and right side positions of an artificial head center in order to be distinguished from each other, for example, if the sound input signal on the one side is a left-side sound input signal, the sound input signal on the other side is a right-side sound input signal, or if the sound input signal on the one side is a right-side sound input signal, the sound input signal on the other side is a left-side sound input signal, where the left-side sound input signal is a simulation of a sound signal that is sent from the left side position of the artificial head center, and the right-side sound input signal is a simulation of a sound signal that is sent from the right side position of the artificial head center.

The generation module 620 is configured to separately perform ratio processing on a preset HRTF left-ear component $h_{\Theta_k,\Phi_k}{}^{l}(n)$ and a preset HRTF right-ear component $h_{\Theta_k,\Phi_k}{}^{r}(n)$ of each sound input signal $s_{2_k}(n)$ on the other side, to obtain a filtering function $h_{\Theta_k,\Phi_k}{}^{c}(n)$ of each sound input signal on the other side, and send the filtering function $h_{\Theta_k,\Phi_k}{}^{c}(n)$ of each sound input signal on the other side to the convolution filtering module 630.

Different HRTF experimental measurement databases can already be provided in the prior art. The generation module 620 may directly acquire, without performing measurement, HRTF data from the HRTF experimental measurement databases in the prior art, to perform presetting, and a simulated sound source position of a sound input signal is a sound source position during measurement of corresponding preset HRTF data. In this implementation manner, each sound input signal correspondingly comes from a different preset simulated sound source, and therefore a different piece of HRTF data is correspondingly preset for each sound input signal. The preset HRTF data of each sound input signal can express a filtering effect on the sound input signal that is transmitted from a preset position to the two ears. Furthermore, preset HRTF data $h_{\Theta_k,\Phi_k}(n)$ of the $k^{th}$ sound input signal on the other side includes two pieces of data, which are respectively a left-ear component $h_{\Theta_k,\Phi_k}{}^{l}(n)$ that expresses a filtering effect on the sound input signal that is transmitted to the left ear of the artificial head and a right-ear component $h_{\Theta_k,\Phi_k}{}^{r}(n)$ that expresses a filtering effect on the sound input signal that is transmitted to the right ear of the artificial head.

The generation module 620 performs ratio processing on the left-ear component $h_{\Theta_k,\Phi_k}{}^{l}(n)$ and the right-ear component $h_{\Theta_k,\Phi_k}{}^{r}(n)$ in preset HRTF data of each sound input signal $s_{2_k}(n)$ on the other side, to obtain the filtering function $h_{\Theta_k,\Phi_k}{}^{c}(n)$ of each sound input signal on the other side, for example, the generation module 620 directly transforms the preset HRTF left-ear component and the preset HRTF right-ear component of the sound input signal on the other side to frequency domain, performs a ratio operation to obtain a value, and uses the obtained value as the filtering function of the sound input signal on the other side, or the generation module 620 first transforms the preset HRTF left-ear component and the preset HRTF right-ear component of the sound input signal on the other side to frequency domain, performs subband smoothing, then performs a ratio operation to obtain a value, and uses the obtained value as the filtering function.

The convolution filtering module 630 is configured to separately perform convolution filtering on each sound input signal $s_{2_k}(n)$ on the other side and the filtering function $h_{\Theta_k,\Phi_k}{}^{c}(n)$ of the sound input signal $s_{2_k}{}^{h}(n)$ on the other side, to obtain the filtered signal on the other side, and send all of the filtered signals $s_{2_k}{}^{h}(n)$ on the other side to the synthesis module 640.

The convolution filtering module 630 calculates the filtered signal $s_{2_k}{}^{h}(n)$ on the other side corresponding to each sound input signal $s_{2_k}(n)$ on the other side according to a formula $s_{2_k}{}^{h}(n)=\mathrm{conv}(h_{\Theta_k,\Phi_k}{}^{c}(n),s_{2_k}(n))$, where conv(x, y) represents a convolution of vectors x and y, $s_{2_k}{}^{h}(n)$ represents the $k^{th}$ filtered signal on the other side, $h_{\Theta_k,\Phi_k}{}^{c}(n)$ represents a filtering function of the $k^{th}$ sound input signal on the other side, and $s_{2_k}(n)$ represents the $k^{th}$ sound input signal on the other side.

The synthesis module 640 is configured to synthesize all of the sound input signals $s_{1_m}(n)$ on the one side and all of the filtered signals $s_{2_k}{}^{h}(n)$ on the other side into a virtual stereo signal $s^1(n)$.

The synthesis module 640 is configured to synthesize, according to $$s^1(n)=\sum_{m=1}^{M} s_{1m}(n)+\sum_{k=1}^{K} s_{2_k}^{h}(n),$$

all of the received sound input signals $s_{1_m}(n)$ on the one side and all of the filtered signals $s_{2_k}{}^{h}(n)$ on the other side into the virtual stereo signal $s^1(n)$.

In this implementation manner, ratio processing is performed on left-ear and right-ear components of preset HRTF data of each sound input signal on the other side, to obtain a filtering function that retains orientation information of the preset HRTF data such that during synthesis of a virtual stereo, convolution filtering processing needs to be performed on only the sound input signal on the other side using the filtering function, and the sound input signal on the other side and a sound input signal on one side are synthesized to obtain the virtual stereo, without a need to simultaneously perform convolution filtering on the sound input signals that are on the two sides, which greatly reduces calculation complexity, and during synthesis, convolution processing does not need to be performed on the sound input signal on the one side, and therefore an original audio is retained, which further alleviates a coloration effect, and improves sound quality of the virtual stereo.

It should be noted that, in this implementation manner, the generated virtual stereo is a virtual stereo that is input to an ear on one side, for example, if the sound input signal on the one side is a left-side sound input signal, and the sound input signal on the other side is a right-side sound input signal, the virtual stereo signal obtained by the foregoing module is a left-ear virtual stereo signal that is directly input to the left ear, or if the sound input signal on the one side is a right-side sound input signal, and the sound input signal on the other side is a left-side sound input signal, the virtual stereo signal obtained by the foregoing module is a right-ear virtual stereo signal that is directly input to the right ear. In the foregoing manner, the virtual stereo synthesis apparatus can separately obtain a left-ear virtual stereo signal and a right-ear virtual stereo signal, and output the signals to the two ears using a headset, to achieve a stereo effect that is like a natural sound.

Figure 7:
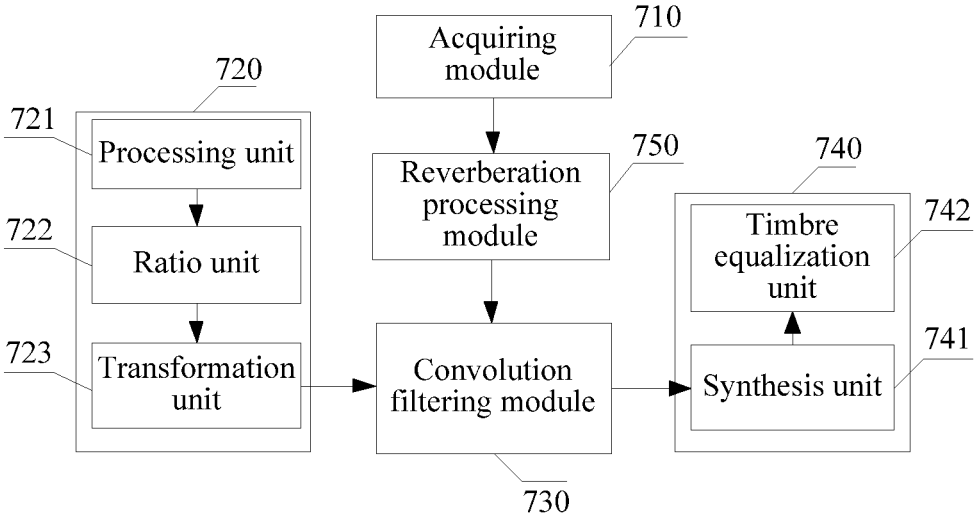
FIG. 7 is a schematic structural diagram of another implementation manner of a virtual stereo synthesis apparatus according to this application.

Referring to FIG. 7, FIG. 7 is a schematic structural diagram of another implementation manner of a virtual stereo synthesis apparatus according to the present disclosure. In this implementation manner, the virtual stereo synthesis apparatus includes an acquiring module 710, a generation module 720, a convolution filtering module 730, a synthesis module 740, and a reverberation processing module 750, where the synthesis module 740 includes a synthesis unit 741 and a timbre equalization unit 742.

The acquiring module 710 is configured to acquire at least one sound input signal $s_{1_m}(n)$ one side and at least one sound input signal $s_{2_k}(n)$ on the other side.

The generation module 720 is configured to separately perform ratio processing on a preset HRTF left-ear component $h_{\theta_k,\phi_k}{}^{l}(n)$ and a preset HRTF right-ear component $h_{\theta_k,\phi_k}{}^{r}(n)$ of each sound input signal $s_{2_k}(n)$ on the other side, to obtain a filtering function $h_{\theta_k,\phi_k}{}^{c}(n)$ of each sound input signal on the other side, and send the filtering function to the convolution filtering module 730.

Further optimized, the generation module 720 includes a processing unit 721, a ratio unit 722, and a transformation unit 723.

The processing unit 721 is configured to separately use a frequency domain, after diffuse-field equalization and subband smoothing is performed in sequence, of the preset HRTF left-ear component $h_{\theta_k,\phi_k}{}^{l}(n)$ of each sound input signal on the other side as a left-ear frequency domain parameter of each sound input signal on the other side, separately use a frequency domain, after diffuse-field equalization and subband smoothing is performed in sequence, of the preset HRTF right-ear component $h_{\theta_k,\phi_k}{}^{r}(n)$ of each sound input signal on the other side as a right-ear frequency domain parameter of each sound input signal on the other side, and send the left-ear and right-ear frequency domain parameters to the ratio unit 722.

a. The processing unit 721 performs diffuse-field equalization on preset HRTF data $h_{\theta_k,\phi_k}(n)$ of the sound input signal on the other side. A preset HRTF data of the $k^{th}$ sound input signal on the other side is represented by $h_{\theta_k,\phi_k}(n)$, where a horizontal angle between a simulated sound source of the $k^{th}$ sound input signal on the other side and an artificial head center is $\theta_k$, an elevation angle between the simulated sound source of the $k^{th}$ sound input signal on the other side and the artificial head center is $\phi_k$, and $h_{\theta_k,\phi_k}(n)$ includes two pieces of data: a left-ear component $h_{\theta_k,\phi_k}{}^{l}(n)$ and a right-ear component $h_{\theta_k,\phi_k}{}^{r}(n)$. Generally, a preset HRTF data obtained by means of measurement in a laboratory not only includes filter model data of transmission paths from a speaker, used as a sound source, to two ears of an artificial head, but also includes interference data such as a frequency response of the speaker, a frequency response of microphones that are disposed at the two ears to receive a signal of the speaker, and a frequency response of an ear canal of an artificial ear. These interference data affects a sense of orientation and a sense of distance of a synthetic virtual sound. Therefore, in this implementation manner, an optimal manner is used, in which the foregoing interference data is eliminated by means of diffuse-field equalization.

(1) Furthermore, the processing unit 721 calculates that a frequency domain of the preset HRTF data $h_{\theta_k,\phi_k}(n)$ of the sound input signal on the other side is $H_{\theta_k,\phi_k}(n)$.

(2) The processing unit 721 calculates an average energy spectrum DF _avg(n), in all directions, of the preset HRTF data frequency domain $H_{\theta_k,\phi_k}(n)$ of the sound input signal on the other side:

$$\mathrm{DF_avg}(n) = \frac{1}{(2*T*P)} \sum_{\varphi_k=\varphi_1}^{\varphi_P} \sum_{\theta_k=\theta_1}^{\theta_T} |H_{\theta_k,\varphi_k}(n)|^2,$$

where $|H_{\theta_k,\phi_k}(n)|$ represents a modulus of $H_{\theta_k,\phi_k}(n)$, P and T represent a quantity P of elevation angles between test sound sources and an artificial head center, and a quantity T of horizontal angles between the test sound sources and the artificial head center, where P and T are included in an HRTF experimental measurement database in which $H_{\theta_k,\phi_k}(n)$ is located. In the present disclosure, when HRTF data in different HRTF experimental measurement databases is used, the quantity P of elevation angles and the quantity T of horizontal angles may be different.

(3) The processing unit 721 inverses the average energy spectrum DF _avg(n), to obtain an inversion DF inv(n) of the average energy spectrum of the preset HRTF data frequency domain $H_{\theta_k,\phi_k}(n)$:

$$\mathrm{DF_inv}(n) = \frac{1}{\mathrm{DF_avg}(n)}.$$

(4) The processing unit 721 transforms the inversion DF _inv(n) of the average energy spectrum of the preset HRTF data frequency domain $H_{\theta_k,\phi_k}(n)$ to time domain, and takes a real value, to obtain an average inverse filtering sequence df _inv(n) of the preset HRTF data:

$$\mathrm{df_inv}(n)=\mathrm{real}(\mathrm{InvFT}(\mathrm{DF_inv}(n))),$$

where InvFT( ) represents inverse Fourier transform, and real(x) represents calculation of a real number part of a complex number x.

(5) The processing unit 721 performs convolution on the preset HRTF data $h_{\theta_k,\phi_k}(n)$ of the sound input signal on the other side and the average inverse filtering sequence df _inv(n) of the preset HRTF data, to obtain diffuse-field-equalized preset HRTF data $\bar{h}_{\theta_k,\phi_k}(n)$:

$$\bar{h}_{\theta_k,\phi_k}(n)=\mathrm{conv}(h_{\theta_k,\phi_k}(n),\mathrm{df_inv}(n)),$$

where conv(x,y) represents a convolution of vectors x and y, and $\bar{h}_{\theta_k,\phi_k}(n)$ includes a diffuse-field-equalized preset HRTF left-ear component $\bar{h}_{\theta_k,\phi_k}{}^{l}(n)$ and a diffuse-field-equalized preset HRTF right-ear component $\bar{h}_{\theta_k,\phi_k}{}^{r}(n)$.

The processing unit 721 performs the foregoing processing (1) to (5) on the preset HRTF data $h_{\theta_k,\phi_k}(n)$ of the sound input signal on the other side, to obtain the diffuse-field-equalized HRTF data $\bar{h}_{\theta_k,\phi_k}(n)$.

b. The processing unit 721 performs subband smoothing on the diffuse-field-equalized preset HRTF data $\bar{h}_{\theta_k,\phi_k}(n)$. The processing unit 721 transforms the diffuse-field-equalized preset HRTF data $\bar{h}_{\theta_k,\phi_k}(n)$ to frequency domain, to obtain a frequency domain $\bar{H}_{\theta_k,\phi_k}(n)$ of the diffuse-field-equalized preset HRTF data. A time-domain transformation length of $\bar{h}_{\theta_k,\phi_k}(n)$ is $N_1$, and a quantity of frequency domain coefficients of $\bar{H}_{\theta_k,\phi_k}(n)$ is $N_2$, where $N_2=N1/2+1$.

The processing unit 721 performs subband smoothing on the frequency domain $\bar{H}_{\theta_k,\phi_k}(n)$ of the diffuse-field-equalized preset HRTF data, calculates a modulus, and uses frequency domain data as subband-smoothed preset HRTF data $|\hat{H}_{\theta_k,\phi_k}(n)|$:

$$|\hat{H}_{\theta_k,\varphi_k}(n)| = \frac{1}{\sum_{j=1}^{j_{max}-j_{min}+1} hann(j)} \sum_{j=j_{min}}^{j_{max}} |\bar{H}_{\theta_k,\varphi_k}(j) * hann(j-j_{min}+1)|$$

where $$j_{min} = \begin{cases} n-bw(n) & n-bw(n)>1 \\ 1 & n-bw(n)\le 1 \end{cases}$$

$$j_{max} = \begin{cases} n+bw(n) & n+bw(n)>M \\ M & n+bw(n)\le M \end{cases},$$

$bw(n)=\lfloor 0.2*n \rfloor$, $\lfloor x \rfloor$ represents a maximum integer that is not greater than x, and $$hann(j)=0.5*(1-\cos(2*\pi*j/(2*bw(n)+1))), j=0 \ldots (2*bw(n)+1).$$

c. The processing unit 721 uses a preset HRTF left-ear frequency domain component $\hat{H}_{\Theta_k,\Phi_k}{}^{l}(n)$ after the subband smoothing as a left-ear frequency domain parameter of the sound input signal on the other side, and uses a preset HRTF right-ear frequency domain component $\hat{H}_{\Theta_k,\Phi_k}{}^{r}(n)$ after the subband smoothing as a right-ear frequency domain parameter of the sound input signal on the other side. The left-ear frequency domain parameter represents a preset HRTF left-ear component of the sound input signal on the other side, and the right-ear frequency domain parameter represents a preset HRTF right-ear component of the sound input signal on the other side. Certainly, in another implementation manner, the preset HRTF left-ear component of the sound input signal on the other side may be directly used as the left-ear frequency domain parameter, or the preset HRTF left-ear component that has been subject to diffuse-field equalization may be used as the left-ear frequency domain parameter. It is similar for the right-ear frequency domain parameter.

It should be noted that, in the foregoing description, when diffuse-field equalization and subband smoothing are performed, the preset HRTF data $h_{\Theta_k,\Phi_k}(n)$ is processed. However, the preset HRTF data $h_{\Theta_k,\Phi_k}(n)$ includes two pieces of data: the left-ear component and the right-ear component, and therefore in fact, it is equivalent to that the diffuse-field equalization and the subband smoothing are performed separately on the left-ear component and the right-ear component of a preset HRTF data.

The ratio unit 722 is configured to separately use a ratio of the left-ear frequency domain parameter of the sound input signal on the other side to the right-ear frequency domain parameter of the sound input signal on the other side as a frequency-domain filtering function $H_{\Theta_k,\Phi_k}{}^{c}(n)$ of the sound input signal on the other side. The ratio of the left-ear frequency domain parameter of the sound input signal on the other side to the right-ear frequency domain parameter of the sound input signal on the other side further includes a modulus ratio and an argument difference between the left-ear frequency domain parameter and the right-ear frequency domain parameter, where the modulus ratio and the argument difference are correspondingly used as a modulus and an argument in the frequency-domain filtering function of the sound input signal on the other side, and the obtained filtering function can retain orientation information of the preset HRTF left-ear component and the preset HRTF right-ear component of the sound input signal on the other side.

In this implementation manner, the ratio unit 722 performs a ratio operation on the left-ear frequency domain parameter and the right-ear frequency domain parameter of the sound input signal on the other side. Further, the modulus of the frequency-domain filtering function $H_{\Theta_k,\Phi_k}{}^{c}(n)$ of the sound input signal on the other side is obtained according to $$|H^{c}_{\theta,\varphi_i}(n)| = \frac{\left|H^{\hat{l}}_{\theta,\varphi_i}(n)\right|}{\left|H^{\hat{r}}_{\theta,\varphi_i}(n)\right|},$$

the argument of the frequency-domain filtering function $H_{\Theta_k,\Phi_k}{}^{c}(n)$ is obtained according to $\arg(H_{\Theta,\Phi_i}{}^{c}(n))=\arg(\overline{H}_{\Theta,\Phi_i}{}^{l}(n))-\arg(\overline{H}_{\Theta,\Phi_i}{}^{r}(n))$, and therefore the frequency-domain filtering function $H_{\Theta_k,\Phi_k}{}^{c}(n)$ of the sound input signal on the other side is obtained. $|\hat{H}_{\Theta_k,\Phi_k}{}^{l}(n)|$ and $|\hat{H}_{\Theta_k,\Phi_k}{}^{r}(n)|$ respectively represent a left-ear component and a right-ear component of the subband-smoothed preset HRTF data $|\hat{H}_{\Theta_k,\Phi_k}(n)|$, and $\overline{H}_{\Theta_k,\Phi_k}{}^{l}(n)$ and $\overline{H}_{\Theta_k,\Phi_k}{}^{r}(n)$ respectively represent a left-ear component and a right-ear component of the frequency domain $\overline{H}_{\Theta_k,\Phi_k}(n)$ of the diffuse-field-equalized preset HRTF data. In subband smoothing, only a modulus value of a complex number is processed, that is, a value obtained after subband smoothing is the modulus value of the complex number, and does not include argument information. Therefore, when the argument of the frequency-domain filtering function is calculated, a frequency domain parameter that can represent the preset HRTF data and that includes argument information needs to be used, for example, left and right components of a diffuse-field-equalized HRTF data.

The transformation unit 723 is configured to separately perform minimum phase filtering on the frequency-domain filtering function $H_{\Theta_k,\Phi_k}{}^{c}(n)$ of the sound input signal on the other side, then transform the frequency-domain filtering function to a time-domain function, and use the time-domain function as a filtering function $h_{\Theta_k,\Phi_k}{}^{c}(n)$ of the sound input signal on the other side. The obtained frequency-domain filtering function $H_{\Theta_k,\Phi_k}{}^{c}(n)$ may be expressed as a position-independent delay plus a minimum phase filter. Minimum phase filtering is performed on the obtained frequency-domain filtering function $H_{\Theta_k,\Phi_k}{}^{c}(n)$ in order to reduce a data length and reduce calculation complexity during virtual stereo synthesis, and additionally, a subjective instruction is not affected.

(1) The transformation unit 723 extends the modulus of the frequency-domain filtering function $H_{\Theta_k,\Phi_k}{}^{c}(n)$ obtained by the ratio unit 722 to a time-domain transformation length $N_1$ thereof, and calculates a logarithmic value:

$$\left|\overline{H}^{c}_{\theta_k,\varphi_k}(n)\right| = \begin{cases} -\ln\left(\left|H^{c}_{\theta_k,\varphi_k}(n)\right|\right) & n \le N_2 \\ -\ln\left(\left|H^{c}_{\theta_k,\varphi_k}(N_1-n+1)\right|\right) & N_2 < n \le N_1 \end{cases},$$

where ln(x) is a natural logarithm of x, $N_1$ is a time-domain transformation length of a time domain $h_{\Theta_k,\Phi_k}{}^{c}(n)$ of the frequency-domain filtering function, and $N_2$ is a quantity of frequency domain coefficients of the frequency-domain filtering function $H_{\Theta_k,\Phi_k}{}^{c}(n)$.

(2) The transformation unit 723 performs Hilbert transform on the modulus $|H_{\Theta_k,\Phi_k}{}^{c}(n)|$ of the obtained frequency-domain filtering function $$H_{\Theta_k,\Phi_k}{}^{H}(n)=\mathrm{Hilbert}(|\overline{H}_{\Theta_k,\Phi_k}{}^{c}|),$$

where Hilbert( ) represents Hilbert transform.

(3) The transformation unit 723 obtains a minimum phase filter $H_{\Theta_k,\Phi_k}{}^{mp}(n)$:

$$H^{mp}_{\theta_k,\varphi_k}(n) = |H^{c}_{\theta_k,\varphi_k}(n)|\, e^{i*H^{H}_{\theta_k,\varphi_k}(n)},$$

where $n=1 \ldots N_2$.

(4) The transformation unit 723 calculates a delay $\tau(\theta_k, \phi_k)$:

$$\tau(\theta_k, \varphi_k) = -\left[\frac{fs}{k_{max}^{itd} - k_{min}^{itd} + 1} \sum_{k=k_{min}^{itd}}^{k_{max}^{itd}} \frac{\arg\left(H_{\theta_k,\varphi_k}^{c}(k)\right) - H_{\theta_k,\varphi_k}^{H}(k)}{\pi * fs * \frac{K}{N_2 - 1}}\right].$$

(5) The transformation unit 723 transforms the minimum phase filter $H_{\Theta_k,\Phi_k}^{mp}(n)$ to time domain, to obtain $h_{\Theta_k,\Phi_k}^{mp}(n)$:

$$h_{\Theta_k,\Phi_k}^{mp}(n)=\text{real}(\text{InvFT}(H_{\Theta_k,\Phi_k}^{mp}(n))),$$

where InvFT( ) represents inverse Fourier transform, and real( ) represents a real number part of a complex number x.

(6) The transformation unit 723 truncates the time domain $h_{\Theta_k,\Phi_k}^{mp}(n)$ of the minimum phase filter according to a length $N_0$, and adds the delay $\tau(\theta_k,\phi_k)$:

$$h_{\theta_k,\varphi_k}^{c}(n) = \begin{cases} 0 & 1 \le n \le \tau(\theta_k, \varphi_k) \\ h_{\theta_k,\varphi_k}^{mp}(n - \tau(\theta_k, \varphi_k)) & \tau(\theta_k, \varphi_k) < n \le \tau(\theta_k, \varphi_k) + N_0 \end{cases}.$$

Relatively large coefficients of the minimum phase filter $H_{\Theta_k,\Phi_k}^{mp}(n)$ obtained in (3) are concentrated in the front, and after relatively small coefficients in the rear are removed by means of truncation, a filtering effect does not change greatly. Therefore, generally, to reduce calculation complexity, the time domain $h_{\Theta_k,\Phi_k}^{mp}(n)$ of the minimum phase filter is truncated according to the length $N_0$, where a value of the length $N_0$ may be selected according to the following steps The time domain $h_{\Theta_k,\Phi_k}^{mp}(n)$ of the minimum phase filter is sequentially compared, from the rear to the front, with a preset threshold e. A coefficient less than e is removed, and the comparison is continued to be performed on a coefficient prior to the removed coefficient, and is stopped until a coefficient is greater than e, where a total length of remaining coefficients is $N_0$, and the preset threshold e may be 0.01.

It should be noted that, the foregoing example in which the generation module obtains the filtering function $h_{\Theta_k,\Phi_k}^{c}(n)$ of the sound input signal on the other side is used as an optimal manner, in which diffuse-field equalization, subband smoothing, ratio calculation, and minimum phase filtering is performed in sequence on the left-ear component $h_{\Theta_k,\Phi_k}^{l}(n)$ and the right-ear component $h_{\Theta_k,\Phi_k}^{r}(n)$ of the preset HRTF data of the sound input signal on the other side, to obtain the filtering function $h_{\Theta_k,\Phi_k}^{c}(n)$ of the sound input signal on the other side. However, in another implementation manner, diffuse-field equalization, subband smoothing, and minimum phase filtering are selectively performed. The step of subband smoothing is generally set together with the step of minimum phase filtering, that is, if the step of minimum phase filtering is not performed, the step of subband smoothing is not performed. The step of subband smoothing is added before the step of minimum phase filtering, which further reduces the data length of the obtained filtering function $h_{\Theta_k,\Phi_k}^{c}(n)$ of the sound input signal on the other side, and therefore further reduces calculation complexity during virtual stereo synthesis.

The reverberation processing module 750 is configured to separately perform reverberation processing on each sound input signal $s_{2_k}(n)$ on the other side and then use the processed signal as a sound reverberation signal $\hat{s}_{2_k}(n)$ on the other side, and send the sound reverberation signal on the other side to the convolution filtering module 730.

After acquiring the at least one sound input signal $s_{2_k}(n)$ on the other side, the reverberation processing module 750 separately performs reverberation processing on each sound input signal $s_{2_k}(n)$ on the other side, to enhance filtering effects such as environment reflection and scattering during actual sound broadcasting, and enhance a sense of space of the input signal. In this implementation manner, reverberation processing is implemented using an all-pass filter. Specifics are as follows:

(1) As shown in FIG. 5, filtering is performed on each sound input signal $s_{2_k}(n)$ on the other side using three cascaded Schroeder all-pass filters, to obtain a reverberation signal $\overline{s_{2_k}}(n)$ of each sound input signal $s_{2_k}(n)$ on the other side $$\overline{s_{2_k}}(n)=\text{conv}(h_k(n),s_{2_k}(n-d_k))$$

where conv(x, y) represents a convolution of vectors x and y, $d_k$ is a preset delay of the $k^{th}$ sound input signal on the other side, $h_k(n)$ is an all-pass filter of the $k^{th}$ sound input signal on the other side, and a transfer function thereof is:

$$H_k(z) = \frac{-g_k^1 + z^{-M_k^1}}{1 - g_k^1 * z^{M_k^1}} * \frac{-g_k^2 + z^{-M_k^2}}{1 - g_k^2 * z^{M_k^2}} * \frac{-g_k^3 + z^{-M_k^3}}{1 - g_k^3 * z^{M_k^3}}$$

where $g_k^1$, $g_k^2$, and $g_k^3$ are preset all-pass filter gains corresponding to the $k^{th}$ sound input signal on the other side, and $M_k^1$, $M_k^2$, and $M_k^3$ are preset all-pass filter delays corresponding to the $k^{th}$ sound input signal on the other side.

(2) The reverberation processing module 750 separately adds each sound input signal $s_{2_k}(n)$ on the other side to the reverberation signal $\overline{s_{2_k}}(n)$ of the sound input signal on the other side, to obtain the sound reverberation signal $\hat{s}_{2_k}(n)$ on the other side corresponding to each sound input signal on the other side:

$$\hat{s}_{2_k}(n)=s_{2_k}(n)+w_k\square\overline{s_{2_k}}(n),$$

where $w_k$ is a preset weight of the reverberation signal $\overline{s_{2_k}}(n)$ of the $k^{th}$ sound input signal on the other side, and generally, a larger weight indicates a stronger sense of space of a signal but causes a greater negative effect (for example, an unclear voice or indistinct percussion music). In this implementation manner, a weight of the sound input signal on the other side is determined in the following manner: a suitable value is selected in advance as the weight $w_k$ of the reverberation signal $\overline{s_{2_k}}(n)$ according to an experiment result, where the value enhances the sense of space of the sound input signal on the other side and does not cause a negative effect.

The convolution filtering module 730 is configured to separately perform convolution filtering on each sound reverberation signal $\hat{s}_{2_k}(n)$ on the other side and the filtering function $h_{\Theta_k,\Phi_k}^{c}(n)$ of the corresponding sound input signal on the other side, to obtain a filtered signal $s_{2_k}^{h}(n)$ on the other side, and send the filtered signal on the other side to the synthesis module 740.

After receiving all the sound reverberation signals $\hat{s}_{2_k}(n)$ on the other side, the convolution filtering module 730 performs convolution filtering on each sound reverberation signal $\hat{s}_{2_k}(n)$ on the other side according to a formula $s_{2_k}^{h}(n)=\text{conv}(h_{\Theta_k,\Phi_k}^{c}(n),\hat{s}_{2_k}(n))$, to obtain the filtered signal $s_{2_k}^{h}(n)$ on the other side, where $\hat{s}_{2_k}(n)$ represents the $k^{th}$ sound filtered signal on the other side, $h_{\Theta_k,\Phi_k}^{c}(n)$ represents a filtering function of the $k^{th}$ sound input signal on the other side, and $\hat{s}_{2_k}(n)$ represents the $k^{th}$ sound reverberation signal on the other side.

The synthesis unit 741 is configured to summate all of the sound input signals $s_{1_m}(n)$ on the one side and all of the filtered signals $s_{2_k}{}^h(n)$ on the other side to obtain a synthetic signal, and send the synthetic signal $\bar{s}^1(n)$ to the timbre equalization unit 742.

Furthermore, the synthesis unit 741 obtains the synthetic signal $\bar{s}^1(n)$ corresponding to the one side according to a formula $$\bar{s}^1(n) = \sum_{m=1}^{M} S_{1_m}(n) + \sum_{k=1}^{K} S_{2_k}^h(n).$$

For example, if the sound input signal on the one side is a left-side sound input signal, a left-ear synthetic signal is obtained, or if the sound input signal on the one side is a right-side sound input signal, a right-ear synthetic signal is obtained.

The timbre equalization unit 742 is configured to perform, using a fourth-order IIR filter, timbre equalization on the synthetic signal $\bar{s}^1(n)$ and then use the timbre-equalized synthetic signal as a virtual stereo signal $s^1(n)$.

The timbre equalization unit 742 performs timbre equalization on the synthetic signal $\bar{s}^1(n)$, to reduce a coloration effect, on the synthetic signal, from the convolution-filtered sound input signal on the other side. In this implementation manner, timbre equalization is performed using a fourth-order IIR filter eq(n). Further, the virtual stereo signal $s^1(n)$ that is finally output to the ear on the one side is obtained according to a formula $s^1(n)=\text{conv}(\text{eq}(n),\bar{s}^1(n))$.

A transfer function of eq(n) is $$H(z) = \frac{b_1 + b_2z^{-1} + b_3z^{-2} + b_4z^{-3} + b_5z^{-4}}{a_1 + a_2z^{-1} + a_3z^{-2} + a_4z^{-3} + a_5z^{-4}}, \text{ where}$$

$b_1 = 1.24939117710166$, and $a_1 = 1$.

$b_2 = -4.72162304562892$ $a_2 = -3,76394096632083$ $b_3 = 6.69867047060726$ $a_3 = 5.31928925722012$ $b_4 = -4.22811576399464$ $a_4 = -3.34508050090584$ $b_5 = 1.00174331383528$ $a_5 = 0.789702281674921$

In this implementation manner, which is used as an optimized implementation manner, reverberation processing, convolution filtering operation, virtual stereo synthesis, and timbre equalization are performed in sequence, to finally obtain a virtual stereo. However, in another implementation manner, reverberation processing and/or timbre equalization may not be performed, which is not limited herein.

It should be noted that, the virtual stereo synthesis apparatus of this application may be an independent sound replay device, for example, a mobile terminal such as a mobile phone, a tablet computer, or an MP3 player, and the foregoing functions are also performed by the sound replay device.

Figure 8:
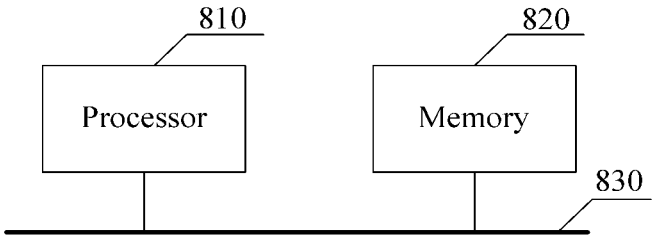
FIG. 8 is a schematic structural diagram of still another implementation manner of a virtual stereo synthesis apparatus according to this application.

Referring to FIG. 8, FIG. 8 is a schematic structural diagram of still another implementation manner of a virtual stereo synthesis apparatus. In this implementation manner, the virtual stereo synthesis apparatus includes a processor 810 and a memory 820, where the processor 810 is connected to the memory 820 using a bus 830.

The memory 820 is configured to store a computer instruction executed by the processor 810 and data that the processor 810 needs to store at work.

The processor 810 executes the computer instruction stored in the memory 820, to acquire at least one sound input signal $s_{1_m}(n)$ on one side and at least one sound input signal $s_{2_k}(n)$ on the other side, separately perform ratio processing on a preset HRTF left-ear component $h_{\Theta_k,\Phi_k}{}^l(n)$ and a preset HRTF right-ear component $h_{\Theta_k,\Phi_k}{}^r(n)$ of each sound input signal $s_{2_k}(n)$ on the other side, to obtain a filtering function $h_{\Theta_k,\Phi_k}{}^c(n)$ of each sound input signal on the other side, separately perform convolution filtering on each sound input signal $s_{2_k}(n)$ on the other side and the filtering function $h_{\Theta_k,\Phi_k}{}^c(n)$ of the sound input signal on the other side, to obtain the filtered signal $s_{2_k}{}^h(n)$ on the other side, and synthesize all of the sound input signals $s_{1_m}(n)$ on the one side and all of the filtered signals $s_{2_k}{}^h(n)$ on the other side into a virtual stereo signal $s^1(n)$.

Further, the processor 810 acquires the at least one sound input signal $s_{1_m}(n)$ on the one side and the at least one sound input signal $s_{2_k}(n)$ on the other side, where $s_{1_m}(n)$ represents the $m^{th}$ sound input signal on the one side, and $s_{2_k}(n)$ represents the $k^{th}$ sound input signal on the other side.

The processor 810 is configured to separately perform ratio processing on a preset HRTF left-ear component $h_{\Theta_k,\Phi_k}{}^l(n)$ and a preset HRTF right-ear component $h_{\Theta_k,\Phi_k}{}^r(n)$ of each sound input signal $s_{2_k}(n)$ on the other side, to obtain a filtering function $h_{\Theta_k,\Phi_k}{}^c(n)$ of each sound input signal on the other side.

Further optimized, the processor 810 separately uses a frequency domain, after diffuse-field equalization and subband smoothing is performed in sequence, of the preset HRTF left-ear component $h_{\Theta_k,\Phi_k}{}^l(n)$ of each sound input signal on the other side as a left-ear frequency domain parameter of each sound input signal on the other side, and separately uses a frequency domain, after diffuse-field equalization and subband smoothing is performed in sequence, of the preset HRTF right-ear component $h_{\Theta_k,\Phi_k}{}^r(n)$ of each sound input signal on the other side as a right-ear frequency domain parameter of each sound input signal on the other side. A manner in which the processor 810 further performs diffuse-field equalization and subband smoothing is the same as that of the processing unit in the foregoing implementation manner. Refer to related text descriptions, and details are not described herein.

The processor 810 separately uses a ratio of the left-ear frequency domain parameter of the sound input signal on the other side to the right-ear frequency domain parameter of the sound input signal on the other side as a frequency-domain filtering function $H_{\Theta_k,\Phi_k}{}^c(n)$ of the sound input signal on the other side. Further, a modulus of the frequency-domain filtering function $H_{\Theta_k,\Phi_k}{}^c(n)$ of the sound input signal on the other side is obtained according to $$|H_{\theta,\varphi_i}^c(n)| = \frac{|\hat{H}_{\theta,\varphi_i}^l(n)|}{|\hat{H}_{\theta,\varphi_i}^r(n)|},$$

an argument of the frequency-domain filtering function $H_{\Theta_k,\Phi_k}{}^c(n)$ is obtained according to $\arg(H_{\Theta_k,\Phi_k}{}^c(n))=\arg(\bar{H}_{\Theta_k,\Phi_k}{}^l(n))-\arg(\bar{H}_{\Theta_k,\Phi_k}{}^r(n))$, and therefore the frequency-domain filtering function $H_{\Theta_k,\Phi_k}{}^c(n)$ of the sound input signal on the other side is obtained. $|\hat{H}_{\Theta_k,\Phi_k}{}^l(n)|$ and $|\hat{H}_{\Theta_k,\Phi_k}{}^r(n)|$ respectively represent a left-ear component and a right-ear component of the subband-smoothed preset HRTF data $|\hat{H}_{\Theta_k,\Phi_k}(n)|$, and $\bar{H}_{\Theta_k,\Phi_k}{}^l(n)$ and $\bar{H}_{\Theta_k,\Phi_k}{}^r(n)$ respectively represent a left-ear component and a right-ear component of the frequency domain $\overline{H}_{\theta_k,\Phi_k}(n)$ of the diffuse-field-equalized preset HRTF data.

The processor 810 separately performs minimum phase filtering on the frequency-domain filtering function $H_{\theta_k,\Phi_k}^{c}(n)$ of the sound input signal on the other side, then transform the frequency-domain filtering function to a time-domain function, and use the time-domain function as the filtering function $h_{\theta_k,\Phi_k}^{c}(n)$ of the sound input signal on the other side. The obtained frequency-domain filtering function $H_{\theta_k,\Phi_k}^{c}(n)$ may be expressed as a position-independent delay plus a minimum phase filter. Minimum phase filtering is performed on the obtained frequency-domain filtering function $H_{\theta_k,\Phi_k}^{c}(n)$ in order to reduce a data length and reduce calculation complexity during virtual stereo synthesis, and additionally, a subjective instruction is not affected. A specific manner in which the processor 810 performs minimum phase filtering is the same as that of the transformation unit in the foregoing implementation manner. Refer to related text descriptions, and details are not described herein.

It should be noted that, the foregoing example in which the processor obtains the filtering function $h_{\theta_k,\Phi_k}^{c}(n)$ of the sound input signal on the other side is used as an optimal manner, in which diffuse-field equalization, subband smoothing, ratio calculation, and minimum phase filtering are performed in sequence on the left-ear component $h_{\theta_k,\Phi_k}^{l}(n)$ and the right-ear component $h_{\theta_k,\Phi_k}^{r}(n)$ of the preset HRTF data of the sound input signal on the other side, to obtain the filtering function $h_{\theta_k,\Phi_k}^{c}(n)$ of the sound input signal on the other side. However, in another implementation manner, diffuse-field equalization, subband smoothing, and minimum phase filtering are selectively performed. The step of subband smoothing is generally set together with the step of minimum phase filtering, that is, if the step of minimum phase filtering is not performed, the step of subband smoothing is not performed. The step of subband smoothing is added before the step of minimum phase filtering, which further reduces the data length of the obtained filtering function $h_{\theta_k,\Phi_k}^{c}(n)$ of the sound input signal on the other side, and therefore further reduces calculation complexity during virtual stereo synthesis.

The processor 810 is configured to separately perform reverberation processing on each sound input signal $s_{2_k}(n)$ on the other side and then use the processed signal as a sound reverberation signal $\hat{s}_{2_k}(n)$ on the other side, to enhance filtering effects such as environment reflection and scattering during actual sound broadcasting, and enhance a sense of space of the input signal. In this implementation manner, reverberation processing is implemented using an all-pass filter. A specific manner in which the processor 810 performs reverberation processing is the same as that of the reverberation processing module in the foregoing implementation manner. Refer to related text descriptions, and details are not described herein.

The processor 810 is configured to separately perform convolution filtering on each sound reverberation signal $\hat{s}_{2_k}(n)$ on the other side and the filtering function $h_{\theta_k,\Phi_k}^{c}(n)$ of the corresponding sound input signal on the other side, to obtain a filtered signal $s_{2_k}^{h}(n)$ on the other side. After receiving all the sound reverberation signals $\hat{s}_{2_k}(n)$ on the other side, the processor 810 performs convolution filtering on each sound reverberation signal $\hat{s}_{2_k}(n)$ on the other side according to a formula $s_{2_k}^{h}(n)=\mathrm{conv}(h_{\theta_k,\Phi_k}^{c}(n),\hat{s}_{2_k}(n))$, to obtain the filtered signal $s_{2_k}^{h}(n)$ on the other side, where $\hat{s}_{2_k}(n)$ represents the $k^{th}$ sound filtered signal on the other side, $h_{\theta_k,\Phi_k}^{c}(n)$ represents a filtering function of the $k^{th}$ sound input signal on the other side, and $\hat{s}_{2_k}(n)$ represents the $k^{th}$ sound reverberation signal on the other side.

The processor 810 is configured to summate all of the sound input signals $s_{1_m}(n)$ on the one side and all of the filtered signals $s_{2_k}^{h}(n)$ on the other side to obtain a synthetic signal $\hat{s}^1(n)$.

Further, the processor 810 obtains the synthetic signal $\bar{s}^1(n)$ corresponding to the one side according to a formula $$\bar{s}^1(n) = \sum_{m=1}^{M} S_{1_m}(n) + \sum_{k=1}^{K} S_{2_k}^{h}(n).$$

For example, if the sound input signal on the one side is a left-side sound input signal, a left-ear synthetic signal is obtained, or if the sound input signal on the one side is a right-side sound input signal, a right-ear synthetic signal is obtained.

The processor 810 is configured to perform, using a fourth-order IIR filter, timbre equalization on the synthetic signal $\bar{s}^1(n)$ and then use the timbre-equalized synthetic signal as a virtual stereo signal $s^1(n)$. A specific manner in which the processor 810 performs timbre equalization is the same as that of the timbre equalization unit in the foregoing implementation manner. Refer to related text descriptions, and details are not described herein.

In this implementation manner, which is used as an optimized implementation manner, reverberation processing, convolution filtering operation, virtual stereo synthesis, and timbre equalization are performed in sequence, to finally obtain a left-ear or right-ear virtual stereo. However, in another implementation manner, the processor may not perform reverberation processing and the timbre equalization may be not performed, which is not limited herein.

By means of the foregoing solutions, in this application, ratio processing is performed on left-ear and right-ear components of preset HRTF data of each sound input signal on the other side, to obtain a filtering function that retains orientation information of the preset HRTF data such that during synthesis of a virtual stereo, convolution filtering processing needs to be performed on only the sound input signal on the other side using the filtering function, and then the sound input signal on the other side and an original sound input signal on one side are synthesized to obtain the virtual stereo, without a need to simultaneously perform convolution filtering on the sound input signals that are on the two sides, which greatly reduces calculation complexity, and during synthesis, convolution processing does not need to be performed on the sound input signal on one of the sides, and therefore an original audio is retained, which further alleviates a coloration effect, and improves sound quality of the virtual stereo.

In the several implementation manners provided in this application, it should be understood that the disclosed system, apparatus, and method may be implemented in other manners. For example, the described apparatus embodiment is merely exemplary. For example, the module or unit division is merely logical function division and may be other division in actual implementation. For example, a plurality of units or components may be combined or integrated into another system, or some features may be ignored or not performed. In addition, the displayed or discussed mutual couplings or direct couplings or communication connections may be implemented through some interfaces. The indirect couplings or communication connections between the apparatuses or units may be implemented in electronic, mechanical, or other forms.

The units described as separate parts may or may not be physically separate, and parts displayed as units may or may not be physical units, may be located in one position, or may be distributed on a plurality of network units. Some or all of the units may be selected according to actual needs to achieve the objectives of the solutions of the embodiments.

In addition, functional units in the embodiments of this application may be integrated into one processing unit, or each of the units may exist alone physically, or two or more units are integrated into one unit. The integrated unit may be implemented in a form of hardware, or may be implemented in a form of a software functional unit.

When the integrated unit is implemented in the form of a software functional unit and sold or used as an independent product, the integrated unit may be stored in a computer-readable storage medium. Based on such an understanding, the technical solutions of this application essentially, or the part contributing to the prior art, or all or a part of the technical solutions may be implemented in the form of a software product. The software product is stored in a storage medium and includes several instructions for instructing a computer device (which may be a personal computer, a server, or a network device) or a processor to perform all or a part of the steps of the methods described in the implementation manners of this application. The foregoing storage medium includes any medium that can store program code, such as a universal serial bus (USB) flash drive, a removable hard disk, a read-only memory (ROM), a random access memory (RAM), a magnetic disk, or an optical disc.

What is claimed is:

1. A virtual stereo synthesis method, comprising:

acquiring at least one sound input signal on a first side and at least one sound input signal on a second side;

separately performing ratio processing on a preset head related transfer function (HRTF) left-ear component and a preset HRTF right-ear component of each sound input signal on the second side, to obtain a filtering function of each of the sound input signals on the second side;

separately performing convolution filtering on each of the sound input signals on the second side and the filtering function of each of the sound input signals on the second side, to obtain filtered signals on the second side; and synthesizing all of the sound input signals on the first side and all of the filtered signals on the second side into a virtual stereo signal, wherein synthesizing all of the sound input signals on the first side and all of the filtered signals on the second side comprises:

summating all of the sound input signals on the first side and all of the filtered signals on the second side to obtain a synthetic signal;

performing, using a fourth-order infinite impulse response (IIR) filter, timbre equalization on the synthetic signal; and using the timbre-equalized synthetic signal as the virtual stereo signal.

2. The method according to claim 1, wherein separately performing the ratio processing comprises:

separately using a ratio of a left-ear frequency domain parameter to a right-ear frequency domain parameter of each of the sound input signals on the second side as a frequency-domain filtering function of each of the sound input signals on the second side, wherein the left-ear frequency domain parameter is related to the preset HRTF left-ear component and wherein-the right-ear frequency domain parameter is related to the preset HRTF right-ear component;

separately transforming the frequency-domain filtering function of each of the sound input signals on the second side to a time-domain function; and using the time-domain function as the filtering function of each of the sound input signals on the second side.

3. The method according to claim 2, wherein separately transforming the frequency-domain filtering function of each of the sound input signals on the second side comprises separately performing minimum phase filtering on the frequency-domain filtering function of each of the sound input signals on the second side.

4. The method according to claim 2, further comprising:

separately using a frequency domain of the preset HRTF left-ear component of each of the sound input signals on the second side as the left-ear frequency domain parameter of each of the sound input signals on the second side, and separately using a frequency domain of the preset HRTF right-ear component of each of the sound input signals on the second side as the right-ear frequency domain parameter of each of the sound input signals on the second side;

separately using a frequency domain of the preset HRTF left-ear component of each of the sound input signals on the second side as the left-ear frequency domain parameter of each of the sound input signals on the second side after diffuse-field equalization or subband smoothing, and separately using the frequency domain of the preset HRTF right-ear component of each of the sound input signals on the second side as the right-ear frequency domain parameter of each of the sound input signals on the second side after the diffuse-field equalization or the subband smoothing; or separately using the frequency domain of the preset HRTF left-ear component of each of the sound input signals on the second side as the left-ear frequency domain parameter of each of the sound input signals on the second side after diffuse-field equalization and subband smoothing is performed in sequence, and separately using the frequency domain of the preset HRTF right-ear component of each of the sound input signals on the second side as the right-ear frequency domain parameter of each of the sound input signals on the second side after diffuse-field equalization and subband smoothing is performed in sequence.

5. The method according to claim 1, wherein separately performing convolution filtering on each of the sound input signals on the second side and the filtering function of each of the sound input signals on the second side comprises:

separately performing reverberation processing on each of the sound input signals on the second side;

using the reverberation processed signals as sound reverberation signals on the second side; and separately performing convolution filtering on each of the sound reverberation signals on the second side and the filtering function of the corresponding sound input signals on the second side, to obtain the filtered signals on the second side.

6. The method according to claim 5, wherein separately performing the reverberation processing on each of the sound input signals on the second side, and using the reverberation processed signals as the sound reverberation signals on the second side comprises:

separately passing each of the sound input signals on the second side through an all-pass filter, to obtain a reverberation signal of each of the sound input signals on the second side; and separately synthesizing each of the sound input signals on the second side and the reverberation signal of each of the sound input signals on the second side into the sound reverberation signals on the second side.

7. A virtual stereo synthesis apparatus, comprising:

a memory comprising instructions; and a processor coupled to the memory, wherein the instructions cause the processor to be configured to:

acquire at least one sound input signal on a first side and at least one sound input signal on a second side;

separately perform ratio processing on a preset head related transfer function (HRTF) left-ear component and a preset HRTF right-ear component of each sound input signal on the second side, to obtain a filtering function of each of the sound input signals on the second side;

separately perform convolution filtering on each of the sound input signals on the second side and on the filtering function of each of the sound input signals on the second side, to obtain filtered signals on the second side; and synthesize all of the sound input signals on the first side and all of the filtered signals on the second side;

summate all of the sound input signals on the first side and all of the filtered signals on the second side to obtain a synthetic signal;

perform, using a fourth-order infinite impulse response (IIR) filter, timbre equalization on the synthetic signal; and use the timbre-equalized synthetic signal as a virtual stereo signal.

8. The virtual stereo synthesis apparatus according to claim 7, wherein the instructions further cause the processor to be configured to:

separately use a ratio of a left-ear frequency domain parameter to a right-ear frequency domain parameter of each of the sound input signals on the second side as a frequency-domain filtering function of each of the sound input signals on the second side, wherein the left-ear frequency domain parameter is related to the preset HRTF left-ear component, and wherein the right-ear frequency domain parameter is related to the preset HRTF right-ear component;

separately transform the frequency-domain filtering function of each of the sound input signals on the second side to a time-domain function; and use the time-domain function as the filtering function of each of the sound input signals on the second side.

9. The virtual stereo synthesis apparatus according to claim 8, wherein the instructions further cause the processor to be configured to separately perform minimum phase filtering on the frequency-domain filtering function of each of the sound input signals on the second side.

10. The virtual stereo synthesis apparatus according to claim 8, wherein the instructions further cause the processor to be configured to:

separately use a frequency domain of the preset HRTF left-ear component of each of the sound input signals on the second side as the left-ear frequency domain parameter of each of the sound input signals on the second side, and separately use a frequency domain of the preset HRTF right-ear component of each of the sound input signals on the second side as the right-ear frequency domain parameter of each of the sound input signals on the second side;

separately use a frequency domain of the preset HRTF left-ear component of each of the sound input signals on the second side as the left-ear frequency domain parameter of each of the sound input signals on the second side after diffuse-field equalization or subband smoothing, and separately use the frequency domain of the preset HRTF right-ear component of each of the sound input signals on the second side as the right-ear frequency domain parameter of each of the sound input signals on the second side after the diffuse-field equalization or the subband smoothing; or separately use the frequency domain, after diffuse-field equalization and subband smoothing is performed in sequence, of the preset HRTF left-ear component of each of the sound input signals on the second side as the left-ear frequency domain parameter of each of the sound input signals on the second side, and separately use the frequency domain of the preset HRTF right-ear component of each of the sound input signals on the second side as the right-ear frequency domain parameter of each of the sound input signals on the second side after diffuse-field equalization and subband smoothing is performed in sequence.

11. The virtual stereo synthesis apparatus according to claim 7, wherein the instructions further cause the processor to be configured to:

separately perform reverberation processing on each of the sound input signals on the second side;

use the reverberation processed signals as sound reverberation signals on the second side; and separately perform convolution filtering on each of the sound reverberation signals on the second side and the filtering function of the corresponding sound input signals on the second side, to obtain the filtered signals on the second side.

12. The virtual stereo synthesis apparatus according to claim 11, wherein the instructions further cause the processor to be configured to:

separately pass each of the sound input signals on the second side through an all-pass filter, to obtain a reverberation signal of each of the sound input signals on the second side; and separately synthesize each of the sound input signals on the second side and the reverberation signal of each of the sound input signals on the second side into the sound reverberation signals on the second side.

13. A non-transitory computer readable storage medium including at least one computer program code stored therein to perform virtual stereo synthesis associated with a computing device wherein when executed on a processor, the computer readable medium causes the processor to:

acquire at least one sound input signal on a first side and at least one sound input signal on a second side;

separately perform ratio processing on a preset head related transfer function (HRTF) left-ear component and a preset HRTF right-ear component of each sound input signal on the second side, to obtain a filtering function of each of the sound input signals on the second side;

separately perform convolution filtering on each of the sound input signals on the second side and the filtering function of each of the sound input signals on the second side, to obtain filtered signals on the second side; and synthesize all of the sound input signals on the first side and all of the filtered signals on the second side;

summate all of the sound input signals on the first side and all of the filtered signals on the second side to obtain a synthetic signal;

perform, using a fourth-order infinite impulse response (IIR) filter, timbre equalization on the synthetic signal; and use the timbre-equalized synthetic signal as a virtual stereo signal.

14. The non-transitory computer readable storage medium according to claim 13, wherein the computer readable medium further causes the processor to be configured to:

separately use a ratio of a left-ear frequency domain parameter to a right-ear frequency domain parameter of each of the sound input signals on the second side as a frequency-domain filtering function of each of the sound input signals on the second side, wherein the left-ear frequency domain parameter is related to the preset HRTF left-ear component, and wherein the right-ear frequency domain parameter is related to the preset HTRF right-ear component;

separately transform the frequency-domain filtering function of each of the sound input signals on the second side to a time-domain function; and use the time-domain function as the filtering function of each of the sound input signals on the second side.

15. The non-transitory computer readable storage medium according to claim 14, wherein the computer readable medium further causes the processor to be configured to:

separately perform minimum phase filtering on the frequency-domain filtering function of each of the sound input signals on the second side;

transform the frequency-domain filtering function to the time-domain function; and use the time-domain function as the filtering function of each of the sound input signals on the second side.

16. The non-transitory computer readable storage medium according to claim 14, wherein the computer readable medium further causes the processor to be configured to:

separately use a frequency domain of the preset HRTF left-ear component of each of the sound input signals on the second side as the left-ear frequency domain parameter of each of the sound input signal on the second side, and separately use a frequency domain of the preset HRTF right-ear component of each of the sound input signals on the second side as the right-ear frequency domain parameter of each of the sound input signals on the second side;

separately use a frequency domain of the preset HRTF left-ear component of each of the sound input signals on the second side as the left-ear frequency domain parameter of each of the sound input signals on the second side after diffuse-field equalization or subband smoothing, and separately use the frequency domain of the preset HRTF right-ear component of each of the sound input signals on the second side as the right-ear frequency domain parameter of each of the sound input signals on the second side after diffuse-field equalization or subband smoothing; or separately use the frequency domain of the preset HRTF left-ear component of each of the sound input signals on the second side as the left-ear frequency domain parameter of each of the sound input signals on the second side after diffuse-field equalization and subband smoothing is performed in sequence, and separately use the frequency domain of the preset HRTF right-ear component of each of the sound input signals on the second side as the right-ear frequency domain parameter of each of the sound input signals on the second side after diffuse-field equalization and subband smoothing is performed in sequence.

17. The non-transitory computer readable storage medium according to claim 13, wherein the computer readable medium further causes the processor to be configured to:

separately perform reverberation processing on each of the sound input signals on the second side;

use the reverberation processed signals as sound reverberation signals on the second side; and separately perform convolution filtering on each of the sound reverberation signals on the second side and the filtering function of the corresponding sound input signals on the second side, to obtain the filtered signals on the second side.

18. The non-transitory computer readable storage medium according to claim 17, wherein the computer readable medium further causes the processor to be configured to:

separately pass each of the sound input signals on the second side through an all-pass filter, to obtain a reverberation signal of each of the sound input signals on the second side; and separately synthesize each of the sound input signals on the second side and the reverberation signal of each of the sound input signals on the second side into the sound reverberation signals on the second side.

19. A virtual stereo synthesis method, comprising:

acquiring at least one sound input signal on a first side and at least one sound input signal on a second side;

separately performing ratio processing on a preset head related transfer function (HRTF) left-ear component and a preset HRTF right-ear component of each sound input signal on the second side, to obtain a filtering function of each of the sound input signals on the second side;

separately performing convolution filtering on each of the sound input signals on the second side and the filtering function of each of the sound input signals on the second side, to obtain filtered signals on the second side;

summating all of the sound input signals on the first side and all of the filtered signals on the second side to obtain a synthetic signal;

performing, using a fourth-order infinite impulse response (IIR) filter, timbre equalization on the synthetic signal; and using the timbre-equalized synthetic signal as a virtual stereo signal.

20. A virtual stereo synthesis apparatus, comprising:

a memory comprising instructions; and a processor coupled to the memory, wherein the instructions cause the processor to be configured to:

acquire at least one sound input signal on a first side and at least one sound input signal on a second side;

separately perform ratio processing on a preset head related transfer function (HRTF) left-ear component and a preset HRTF right-ear component of each sound input signal on the second side, to obtain a filtering function of each of the sound input signals on the second side;

separately perform convolution filtering on each of the sound input signals on the second side and on the filtering function of each of the sound input signals on the second side, to obtain filtered signals on the second side;

summate all of the sound input signals on the first side and all of the filtered signals on the second side to obtain a synthetic signal;

perform, using a fourth-order infinite impulse response (IIR) filter, timbre equalization on the synthetic signal; and use the timbre-equalized synthetic signal as a virtual stereo signal.

* * * * *